US009657515B2

(12) United States Patent
Rupel

(10) Patent No.: US 9,657,515 B2
(45) Date of Patent: May 23, 2017

(54) CELLULAR SHADE WITH DIVIDER WEBS

(71) Applicant: Hunter Douglas, Inc., Pearl River, NY (US)

(72) Inventor: John D. Rupel, Pine River, WI (US)

(73) Assignee: Hunter Douglas, Inc., Pearl River, NY (US)

( * ) Notice: Subject to any disclaimer, the term of this patent is extended or adjusted under 35 U.S.C. 154(b) by 0 days.

(21) Appl. No.: 14/574,550

(22) Filed: Dec. 18, 2014

(65) Prior Publication Data

US 2015/0184450 A1 Jul. 2, 2015

Related U.S. Application Data

(60) Provisional application No. 61/922,169, filed on Dec. 31, 2013.

(51) Int. Cl.

| | |
|---|---|
| ***A47H 5/00*** | (2006.01) |
| ***E06B 3/48*** | (2006.01) |
| ***E06B 3/94*** | (2006.01) |
| ***E06B 9/06*** | (2006.01) |
| ***E06B 9/262*** | (2006.01) |

(52) U.S. Cl.

CPC ..... *E06B 9/262* (2013.01); *E06B 2009/2627* (2013.01)

(58) Field of Classification Search

CPC ..... E06B 9/262; E06B 2009/2625; E06B 2009/2627; B32B 3/12

USPC ..... 160/84.05

See application file for complete search history.

(56) References Cited

U.S. PATENT DOCUMENTS

| | | | | |
|---|---|---|---|---|
| 5,129,440 | A | 7/1992 | Colson | |
| 5,313,998 | A | 5/1994 | Colson et al. | |
| 5,390,720 | A | 2/1995 | Colson et al. | |
| 5,425,408 | A | 6/1995 | Colson | |
| 5,428,750 | A * | 6/1995 | Hsieh | H03K 19/1736 710/100 |
| 5,503,210 | A | 4/1996 | Colson et al. | |
| 5,603,368 | A | 2/1997 | Colson et al. | |
| 5,670,000 | A | 9/1997 | Colson et al. | |
| 5,690,778 | A | 11/1997 | Swiszcz et al. | |
| 5,691,031 | A | 11/1997 | Swiszcz et al. | |
| 5,834,090 | A * | 11/1998 | Huang | B31D 3/0215 428/116 |
| 5,974,763 | A | 11/1999 | Colson et al. | |
| 6,066,382 | A | 5/2000 | Swiszcz et al. | |
| 6,095,227 | A | 8/2000 | Colson et al. | |
| 6,164,363 | A | 12/2000 | Colson et al. | |
| 6,170,552 | B1 | 1/2001 | Colson et al. | |
| 6,319,586 | B1 | 11/2001 | Colson | |
| 6,345,486 | B1 | 2/2002 | Colson et al. | |
| 6,427,409 | B2 | 8/2002 | Colson et al. | |

(Continued)

*Primary Examiner* — Katherine Mitchell
*Assistant Examiner* — Jeremy Ramsey
(74) *Attorney, Agent, or Firm* — Dority & Manning, P.A.

(57) ABSTRACT

An extendable and retractable cellular shade may include a plurality of vertically aligned shade cells and one or more divider webs extending within each shade cells to as to divide the shade cell into two or more cell structures. By adjusting one or more design parameters associated with the cellular shade, the configuration of the shade cells, such as the size and/or shape of the cell structures, and/or the illumination or lighting effects associated with the cellular shade may be specifically tailored to provide a desired aesthetic look or feel for the shade.

20 Claims, 15 Drawing Sheets

(56) References Cited

U.S. PATENT DOCUMENTS

| | | | | |
|---|---|---|---|---|
| 6,989,066 | B2 * | 1/2006 | Yu | B31D 3/002 156/182 |
| 7,404,428 | B2 * | 7/2008 | Sun | E06B 9/262 156/197 |
| D632,493 | S | 2/2011 | Colson et al. | |
| 8,151,857 | B2 | 4/2012 | Colson et al. | |
| 8,393,080 | B2 | 3/2013 | Ballard, Jr. et al. | |
| 8,568,859 | B2 * | 10/2013 | Yu | B32B 3/04 160/115 |
| 2004/0074611 | A1 | 4/2004 | Colson et al. | |
| 2008/0168637 | A1 | 7/2008 | Ballard et al. | |
| 2010/0126675 | A1 | 5/2010 | Jelic et al. | |
| 2010/0276088 | A1 | 11/2010 | Jelic et al. | |
| 2010/0276089 | A1 | 11/2010 | Jelic et al. | |
| 2012/0175070 | A1 * | 7/2012 | Rupel | E06B 9/262 160/84.05 |
| 2012/0193040 | A1 | 8/2012 | Colson et al. | |
| 2012/0318465 | A1 | 12/2012 | Colson | |
| 2013/0133840 | A1 * | 5/2013 | Malkan | E06B 9/262 160/84.05 |
| 2013/0180669 | A1 | 7/2013 | Judkins | |

* cited by examiner

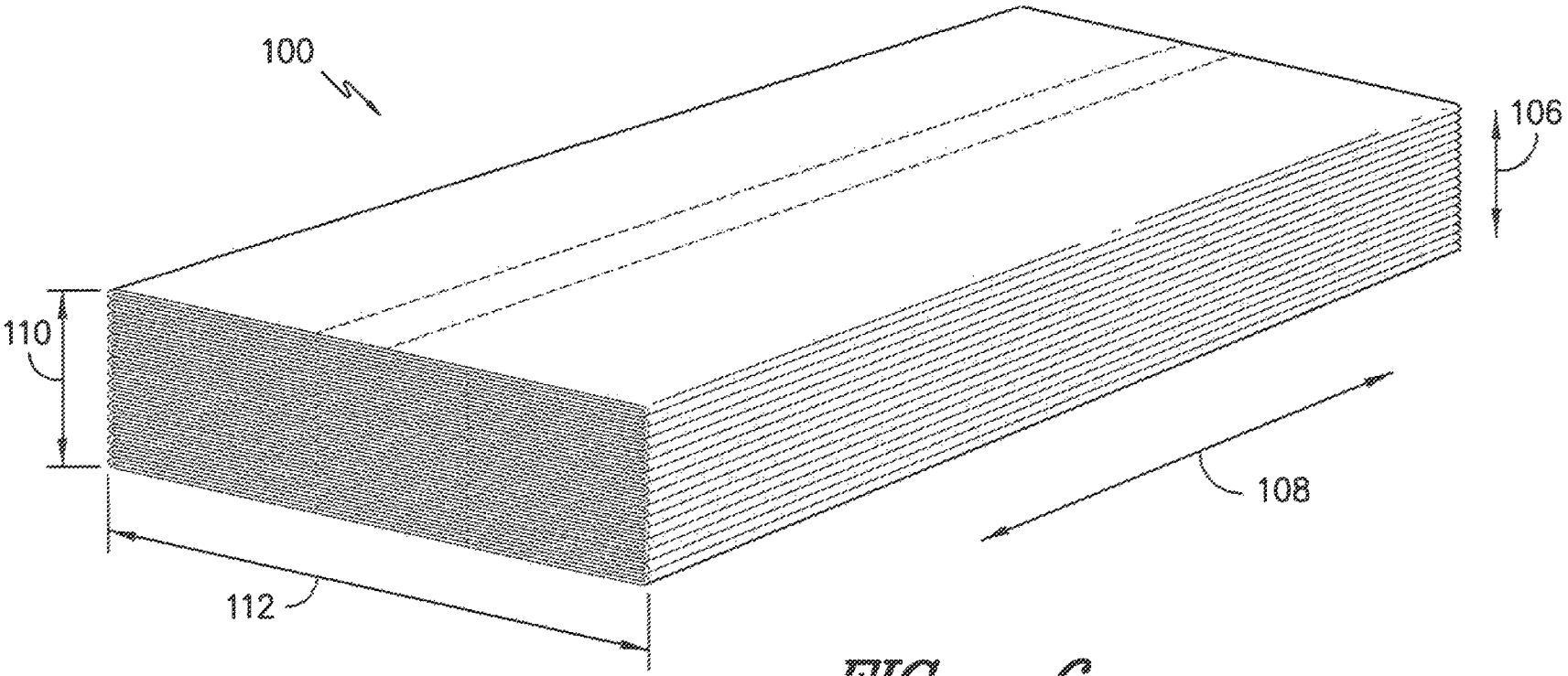
FIG. —6—

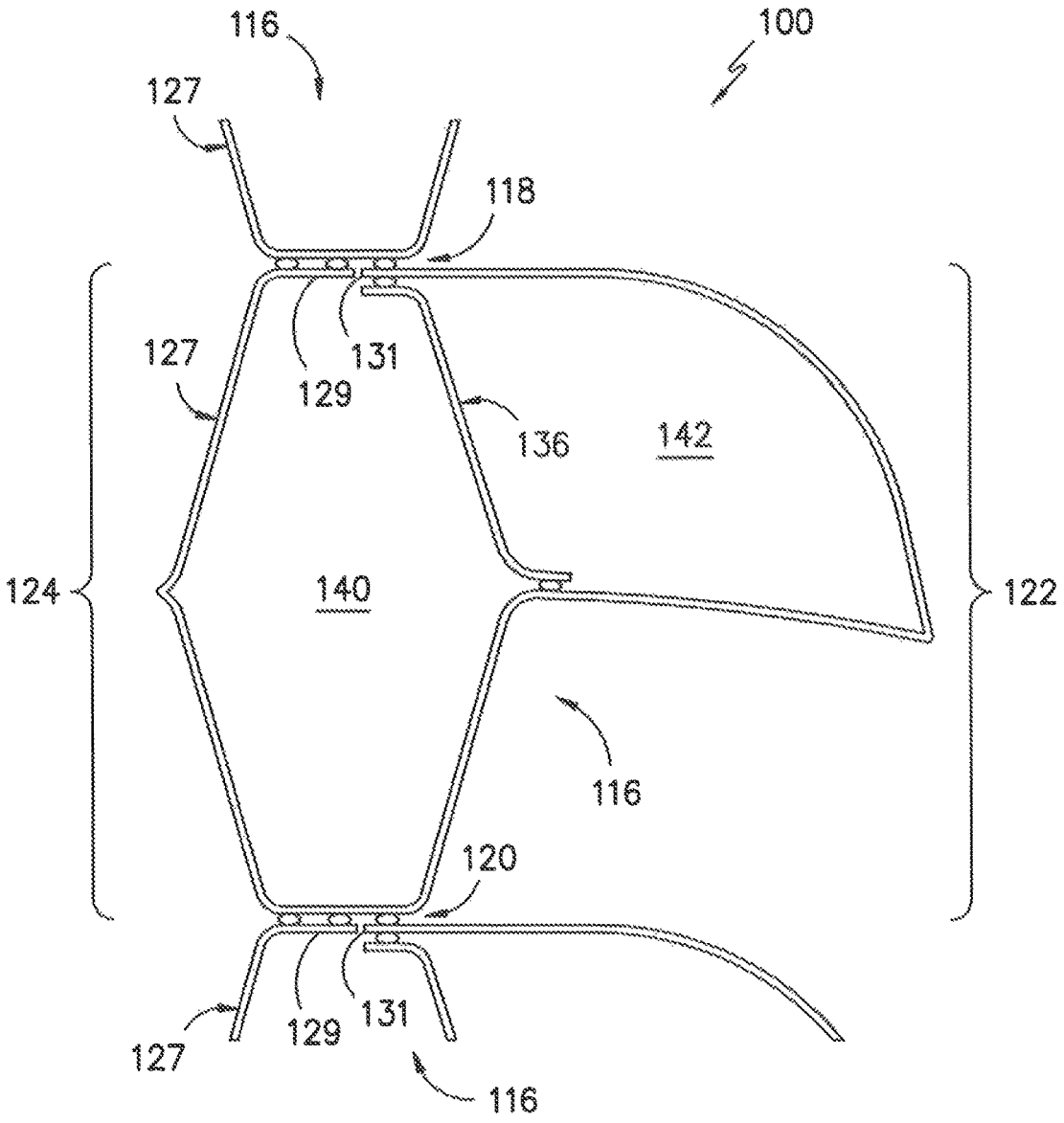
FIG. —7—

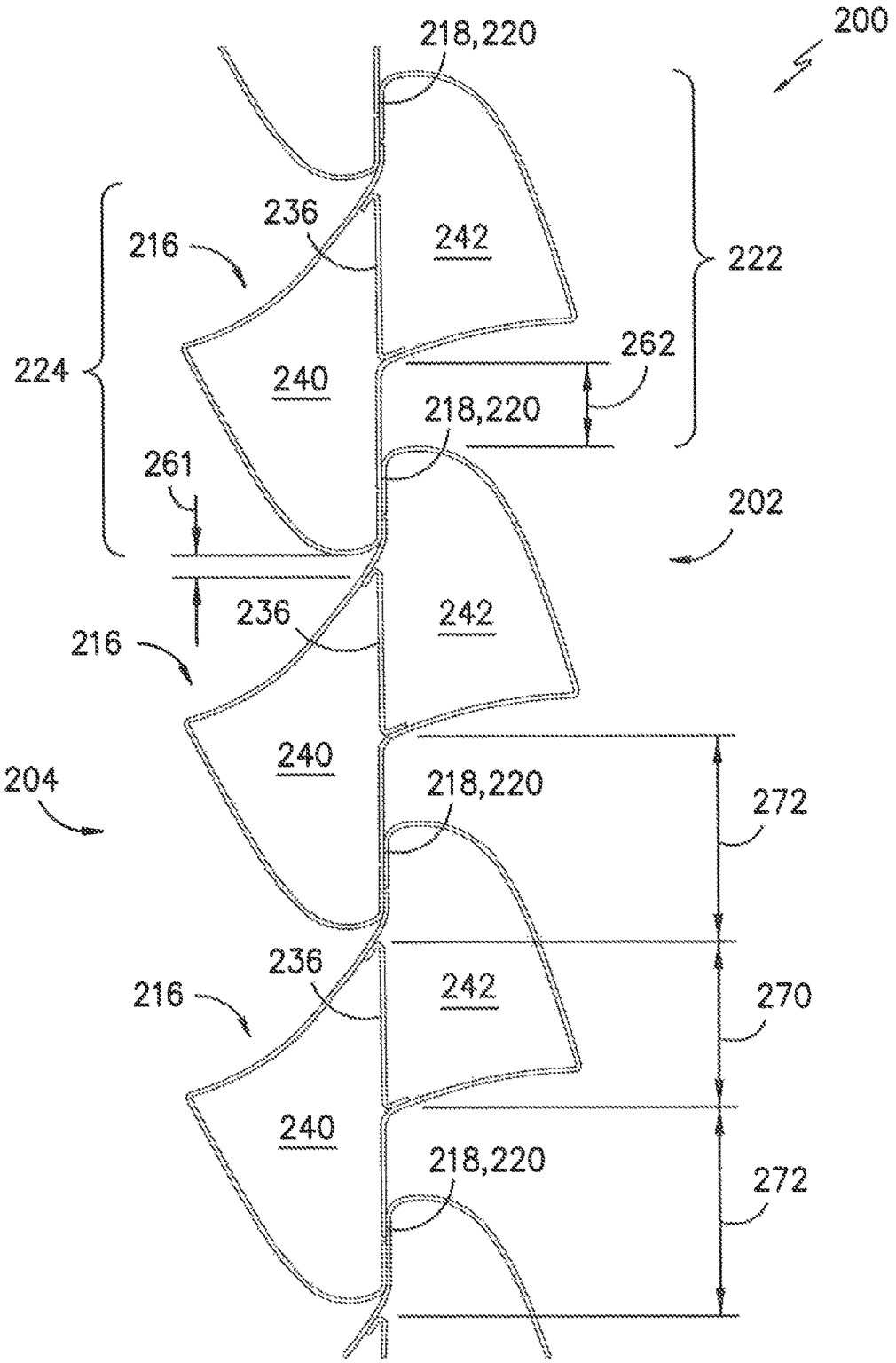
FIG. —8—

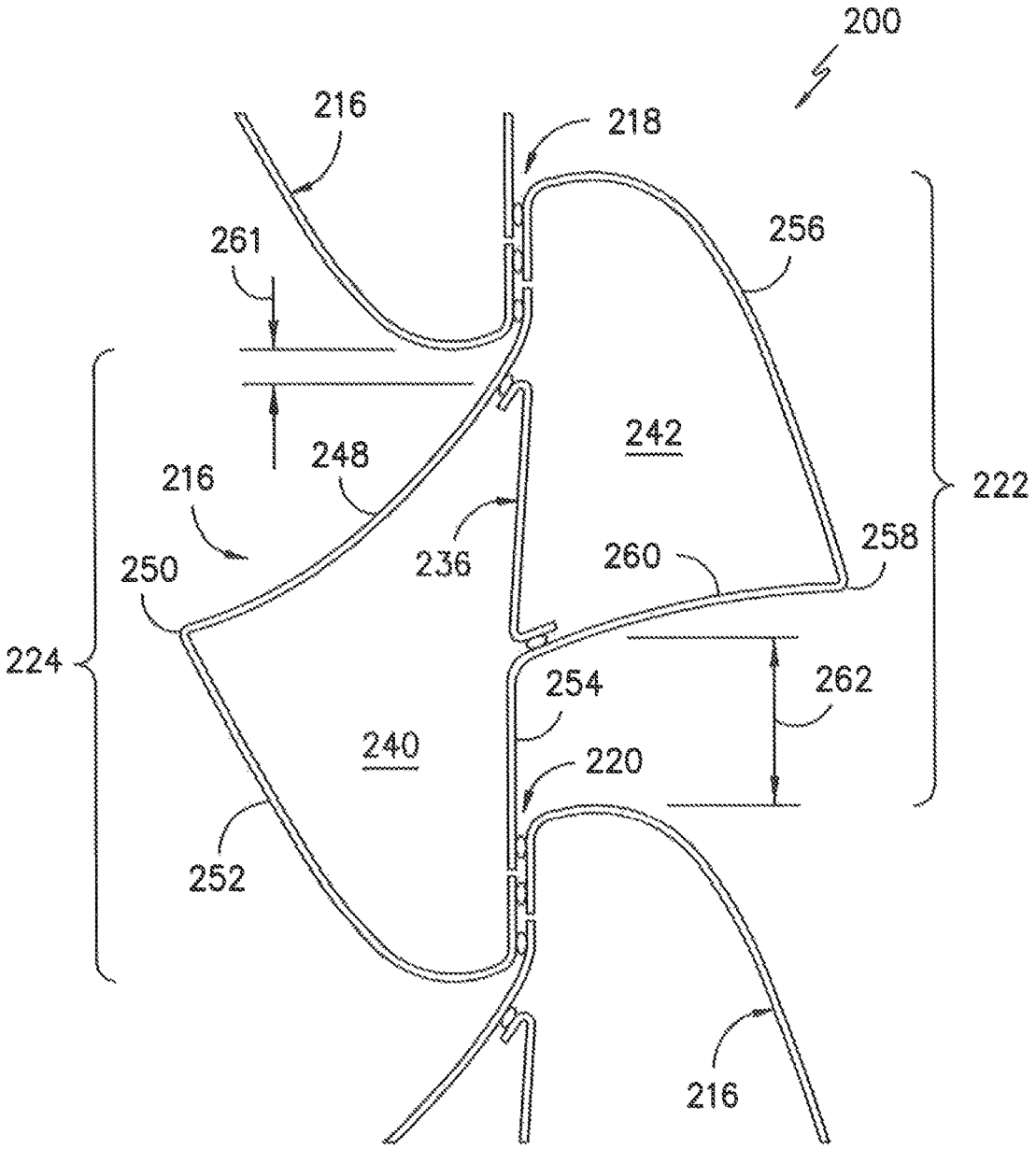
FIG. —9—

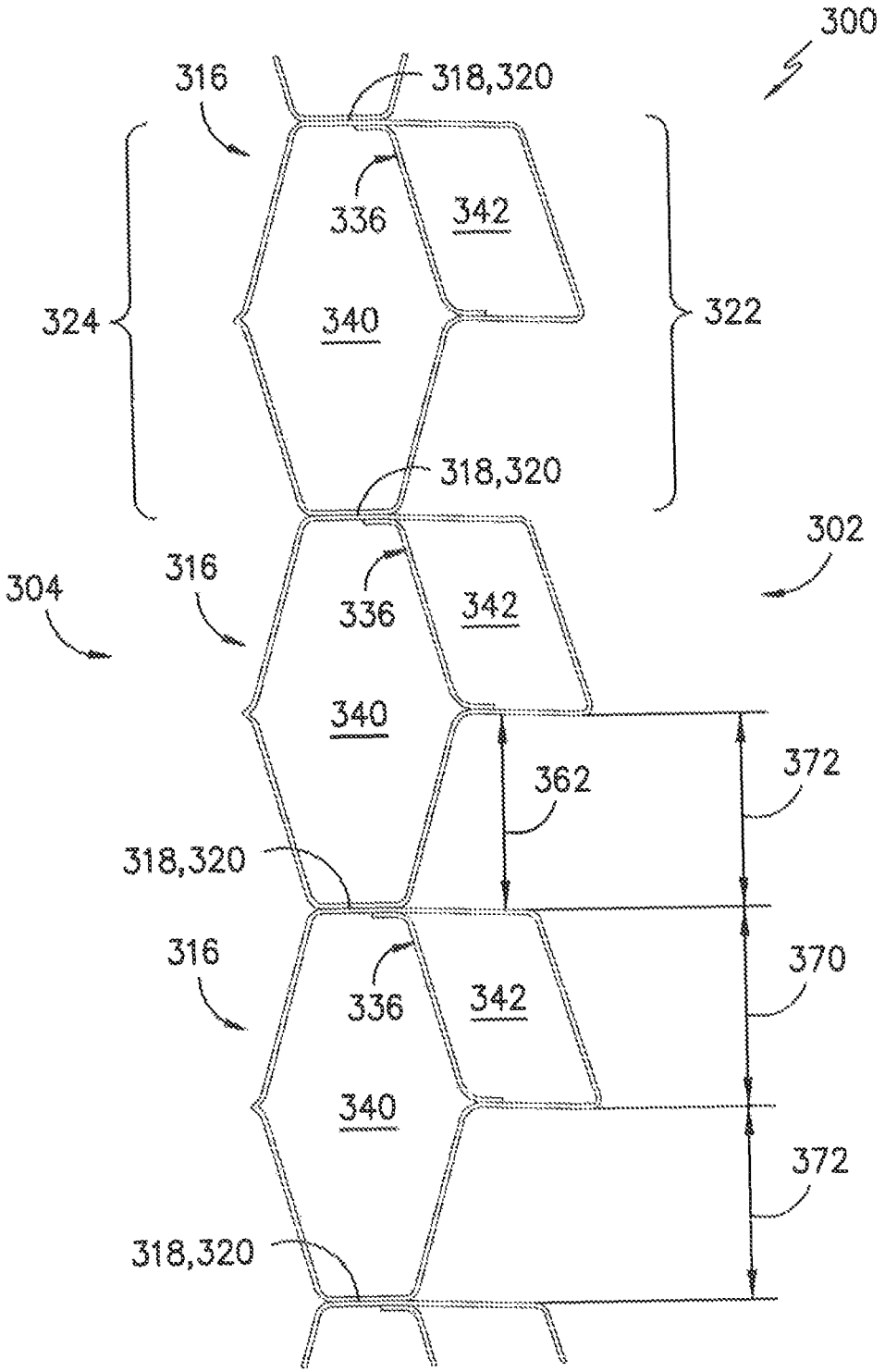
FIG. —10—

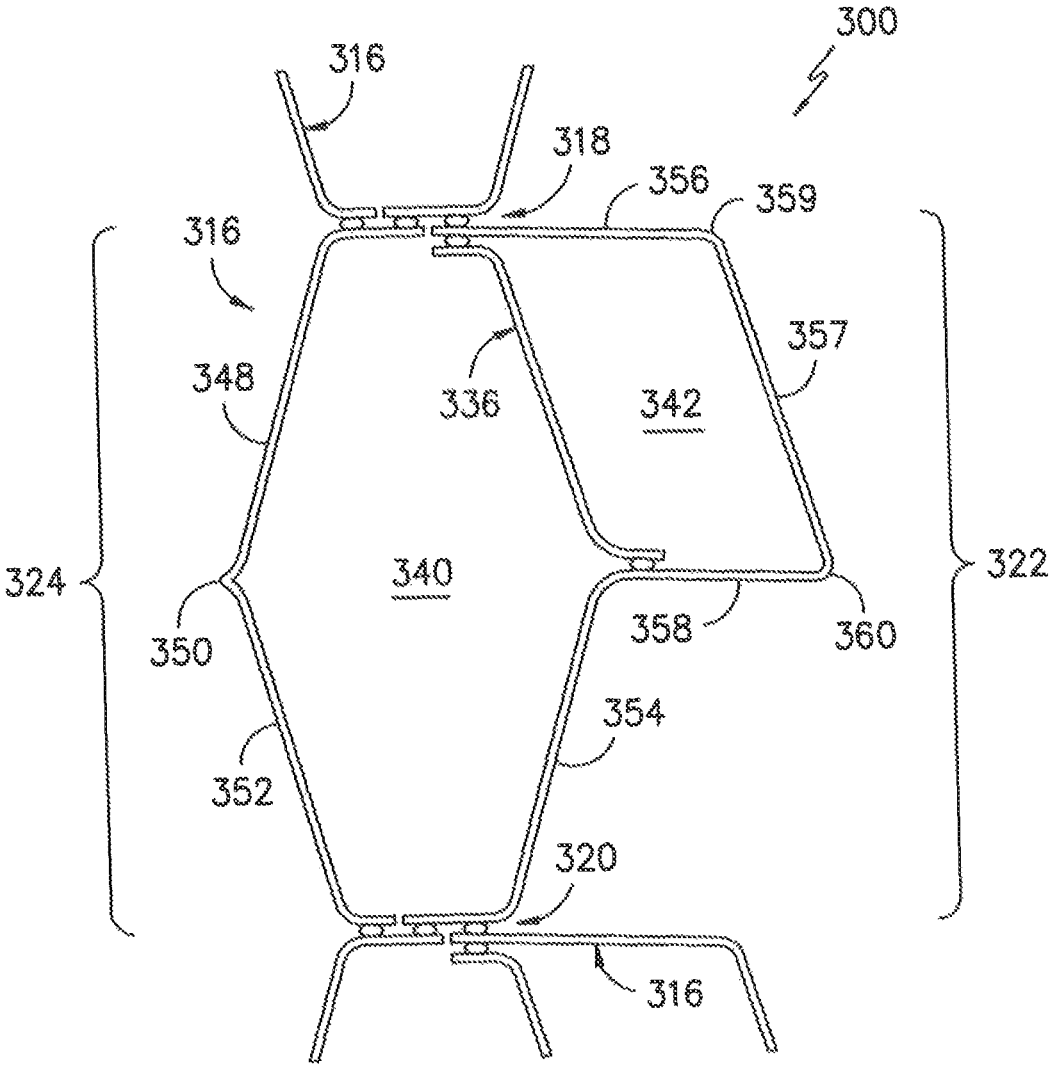
FIG. —11—

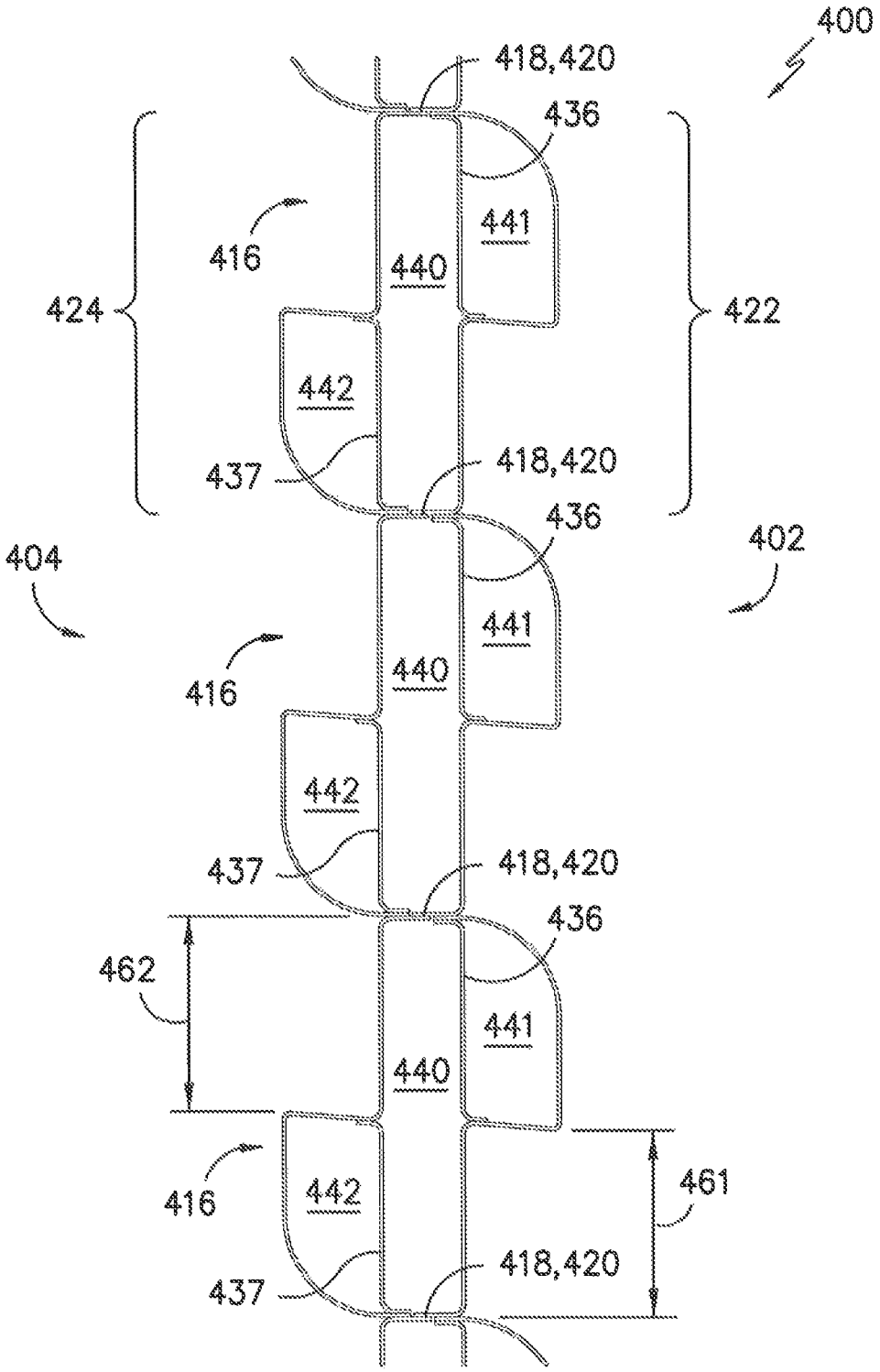
FIG. —12—

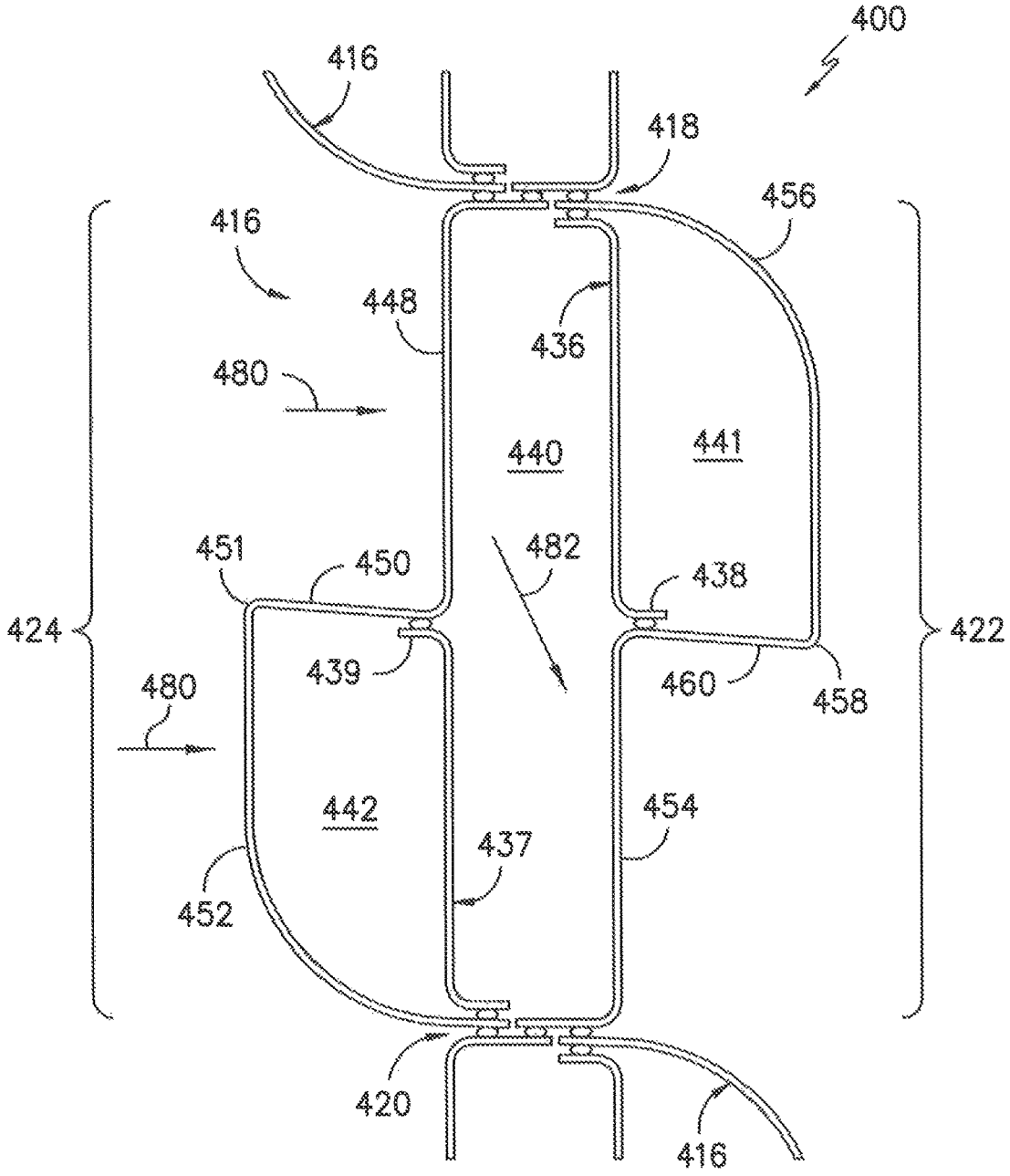
FIG. —13—

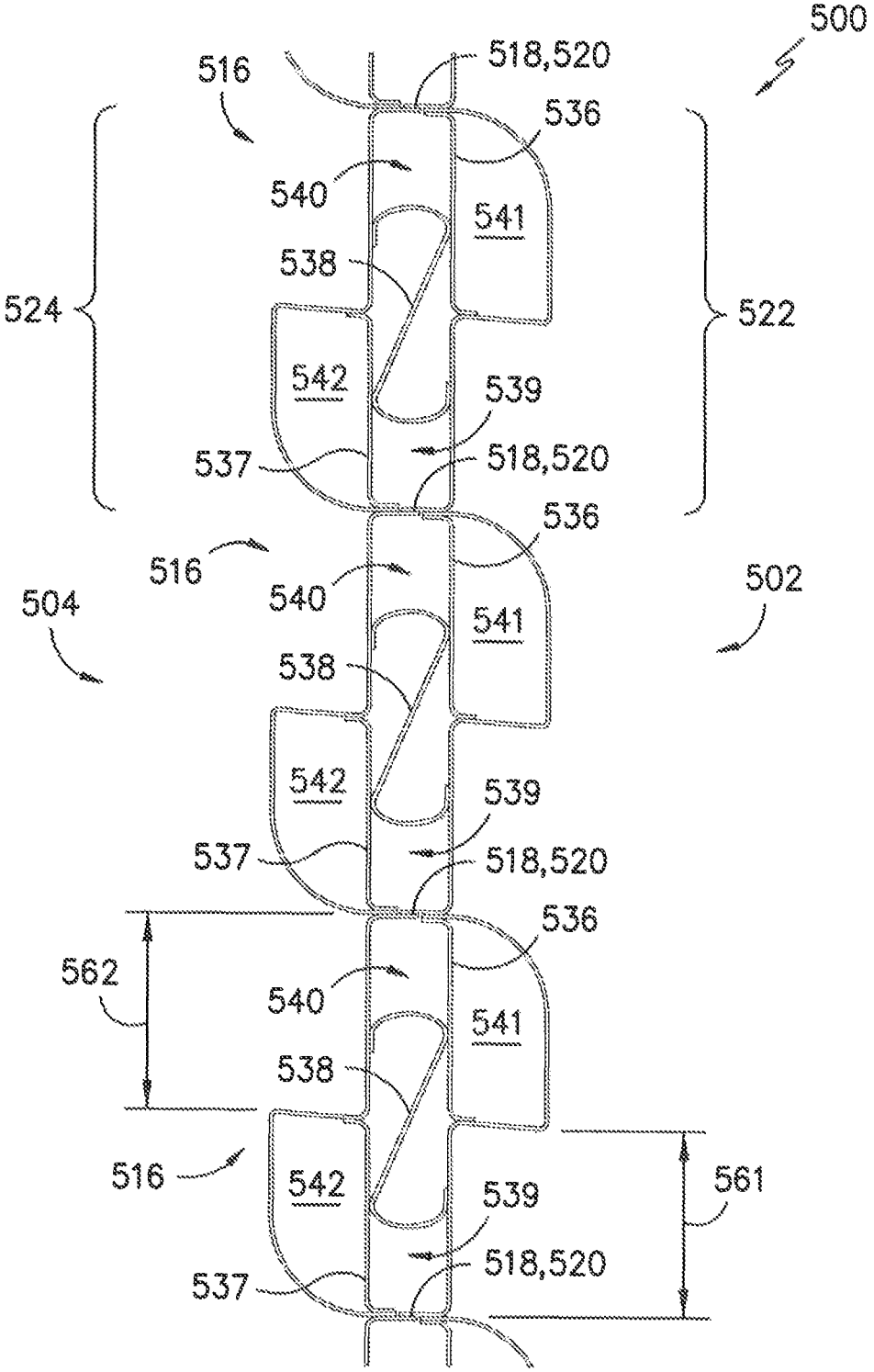
FIG. —14—

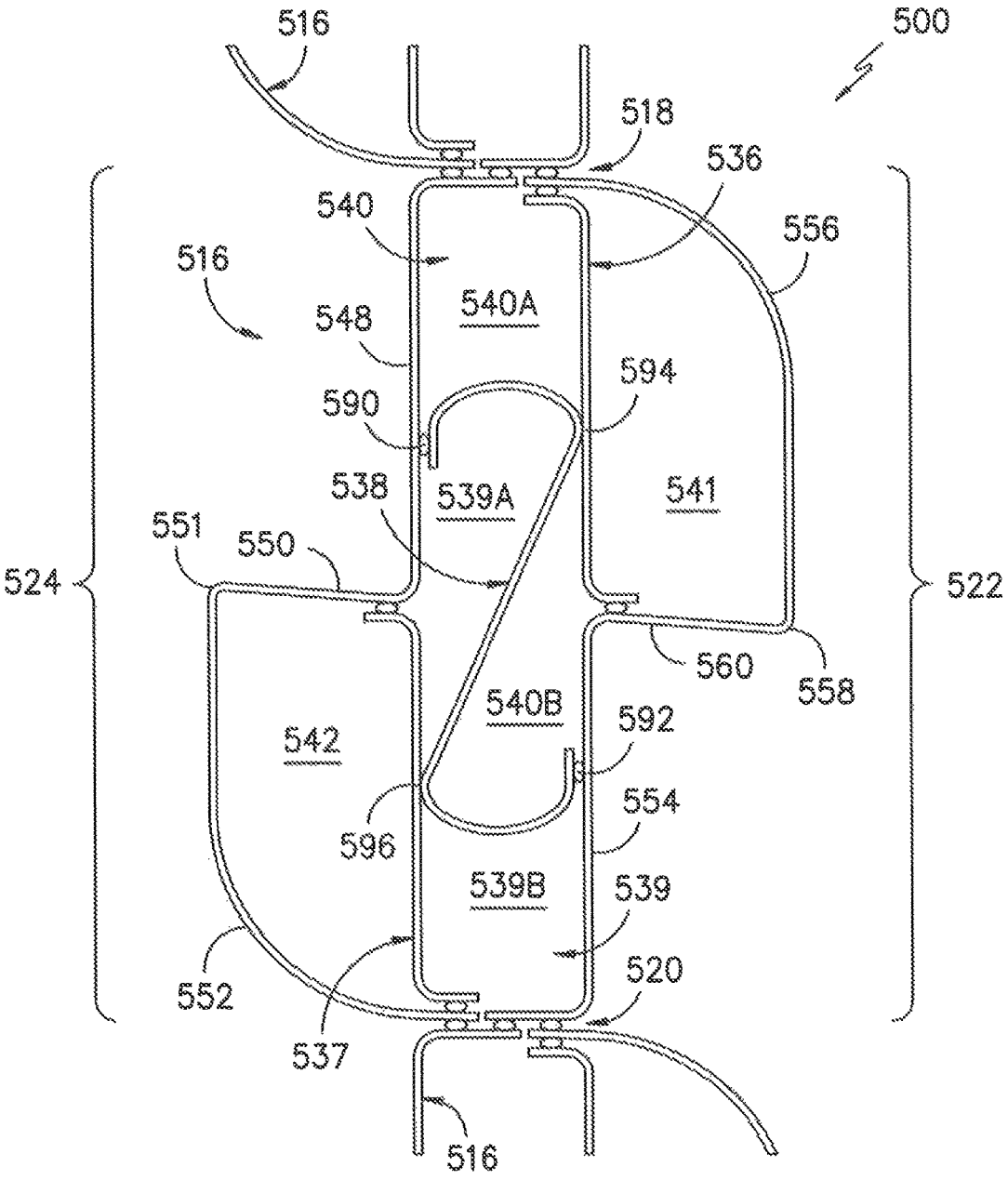
FIG. —15—

CELLULAR SHADE WITH DIVIDER WEBS

CROSS-REFERENCE TO RELATED APPLICATIONS

This application is based upon and claims priority to U.S. Provisional Application No. 61/922,169, filed on Dec. 31, 2013, the disclosure of which is hereby incorporated by reference herein in its entirety for all purposes.

FIELD OF THE INVENTION

The present subject matter relates generally to cellular shades and, more particularly, to a cellular shade having a plurality of vertically aligned shade cells and one or more divider webs extending within each shade cell so as to divide the shade cell into two or more cell structures.

BACKGROUND OF THE INVENTION

Cellular shades have become a popular type of window covering in residential and commercial applications. The shades are aesthetically attractive and also provide improved insulation across a window or other type of opening due to their cellular construction. Cellular shades have assumed various forms, including a plurality of longitudinally extending tubes made of a flexible or semi-rigid material. Cellular shades can, for instance, be mounted at the top of a door or window for extending across an architectural opening. When the shade is in an expanded state, the tubes cover the opening. The shade can be retracted or drawn into a contracted state wherein the tubes collapse into a stack.

The design emphasis in home and building structures has maintained pressure on the industry to continue to create unique aesthetically attractive coverings for architectural openings. Although the introduction of cellular shades has greatly benefited the industry in this regard, there remains a need to create cellular shades having a unique appearance for providing further options to consumers. In addition, conventional cellular shades are typically configured such that the front face of each shade is uniformly illuminated as light is transmitted through the shade. While such uniform illumination is often desirable, a need also exists for a cellular shade that provides for varying amounts of illumination along the front face of the shade to again provide further design options to consumers.

BRIEF DESCRIPTION OF THE INVENTION

Aspects and advantages of the invention will be set forth in part in the following description, or may be obvious from the description, or may be learned through practice of the invention.

In one aspect, the present subject matter is directed to a cellular shade for an architectural opening that is movable between an extended position and a retracted position. The cellular shade may generally include a plurality of first cell structures aligned vertically with one another. Each first cell structure may include a first side and a second side. The first side of each first cell structure may define at least a portion of a first face of the cellular shade. The second side of each first cell structure may be defined at least partially by a first wall segment and a second wall segment. The first and second wall segments may be formed from separate webs. The cellular shade may also include a plurality of second cell structures aligned vertically with one another. Each second cell structure may be positioned adjacent to a corresponding first cell structure of the first cell structures. Each second cell structure may include a first side and a second side. The first side of each second cell structure may be defined by the first wall segment of the corresponding first cell structure. In addition, the second wall segment of each first cell structure and the second side of each second cell structure may define at least a portion of a second face of the cellular shade. The second face may be opposite the first face.

In another aspect, the present subject matter is directed to a cellular shade for an architectural opening that is movable between an extended position and a retracted position. The cellular shade may generally include a plurality of first cell structures aligned vertically with one another. Each first cell structure may be formed by at least one cell web and may include a first side and a second side extending between a first junction line and a second junction line. The cell web(s) may be coupled to at least one separate first adjacent cell web at the first junction line and to at least one separate second adjacent cell web at the second junction line. The cellular shade may also include a plurality of second cell structures aligned vertically with one another. Each second cell structure may be positioned adjacent to and extend outwardly from a corresponding first cell structure of the first cell structures. In addition, when the cellular shade is at the extended position, adjacent second cell structures of the second cell structures may be spaced apart vertically from one another such that a gap is defined between the adjacent second cell structures.

In a further aspect, the present subject matter is directed to a cellular shade for an architectural opening that is movable between an extended position and a retracted position. The cellular shade may generally include a plurality of vertically aligned shade cells. Each shade cell may extend between a first junction line and a second junction line and may be formed by at least one cell web extending between the first and second junction lines. Each shade cell may include a first cell structure and a second cell structure defined within a perimeter formed by the at least one cell web. The cellular shade may also include a divider web extending within each shade cell. The divider web may be coupled to the cell web(s) at separate locations so as to form a common wall between the first cell structure and the second cell structure. The divider web may be formed from a material that allows for less light transmission than a material used to form the at least one cell web. In addition, the divider web may be positioned within each shade cell such that a plurality of first light transmission bands and a plurality of second light transmission bands are formed along a heightwise direction of the cellular shade. The first light transmission bands may allow less light to be transmitted through the cellular shade than the second light transmission bands.

In yet another aspect, the present subject matter is directed to a cellular shade for an architectural opening that is movable between an extended position and a retracted position. The cellular shade may generally include a plurality of vertically aligned shade cells. Each shade cell may extend between a first junction line and a second junction line and may be formed by at least one cell web extending between the first and second junction lines. The cell web(s) may be coupled to at least one separate cell web of a first adjacent shade cell at the first junction line and to at least one separate cell web of a second adjacent shade cell at the second junction line. Each shade cell may include a first cell structure, a second cell structure and a third cell structure defined within a perimeter formed by the at least one cell web. The cellular shade may also include a first divider web extending within each shade cell. The first divider web may be coupled to the cell web(s) at separate locations so as to form a common wall between the first cell structure and the second cell structure. In addition, the cellular shade may also include a second divider web extending within each shade cell. The second divider web may be coupled to the cell web(s) at separate locations so as to form a common wall between the first cell structure and the third cell structure.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which:

FIG. 6 illustrates another partial, front perspective view of the cellular shade shown in FIG. 1, particularly illustrating the cellular shade in a retracted portion;

FIG. 7 illustrates another close-up side view of a portion of the cellular shade shown in FIG. 4, particularly illustrating a shade cell of the cellular shade formed from a single cell web coupled to adjacent shade cells at first and second junction lines;

FIG. 8 illustrates a partial, side view of another embodiment of a cellular shade having a plurality of vertically aligned shade cells and a single divider web dividing each shade cell into two separate cell structures in accordance with aspects of the present subject matter, particularly illustrating the cellular shade in an expanded or extended position;

FIG. 9 illustrates a close-up side view of a portion of the cellular shade shown in FIG. 8;

FIG. 10 illustrates a partial, side view of a further embodiment of a cellular shade having a plurality of vertically aligned shade cells and a single divider web dividing each shade cell into two separate cell structures in accordance with aspects of the present subject matter, particularly illustrating the cellular shade in an expanded or extended position;

FIG. 11 illustrates a close-up side view of a portion of the cellular shade shown in FIG. 10;

FIG. 12 illustrates a partial, side view of yet another embodiment of a cellular shade having a plurality of vertically aligned shade cells and two divider webs dividing each shade cell into three separate cell structures in accordance with aspects of the present subject matter, particularly illustrating the cellular shade in an expanded or extended position;

FIG. 13 illustrates a close-up side view of a portion of the cellular shade shown in FIG. 12;

FIG. 14 illustrates a partial, side view of another embodiment of a cellular shade having a plurality of vertically aligned shade cells and three divider webs dividing each shade cell into four separate cell structures in accordance with aspects of the present subject matter, particularly illustrating the cellular shade in an expanded or extended position; and FIG. 15 illustrates a close-up side view of a portion of the cellular shade shown in FIG. 14.

DETAILED DESCRIPTION OF THE INVENTION

Figure 1:
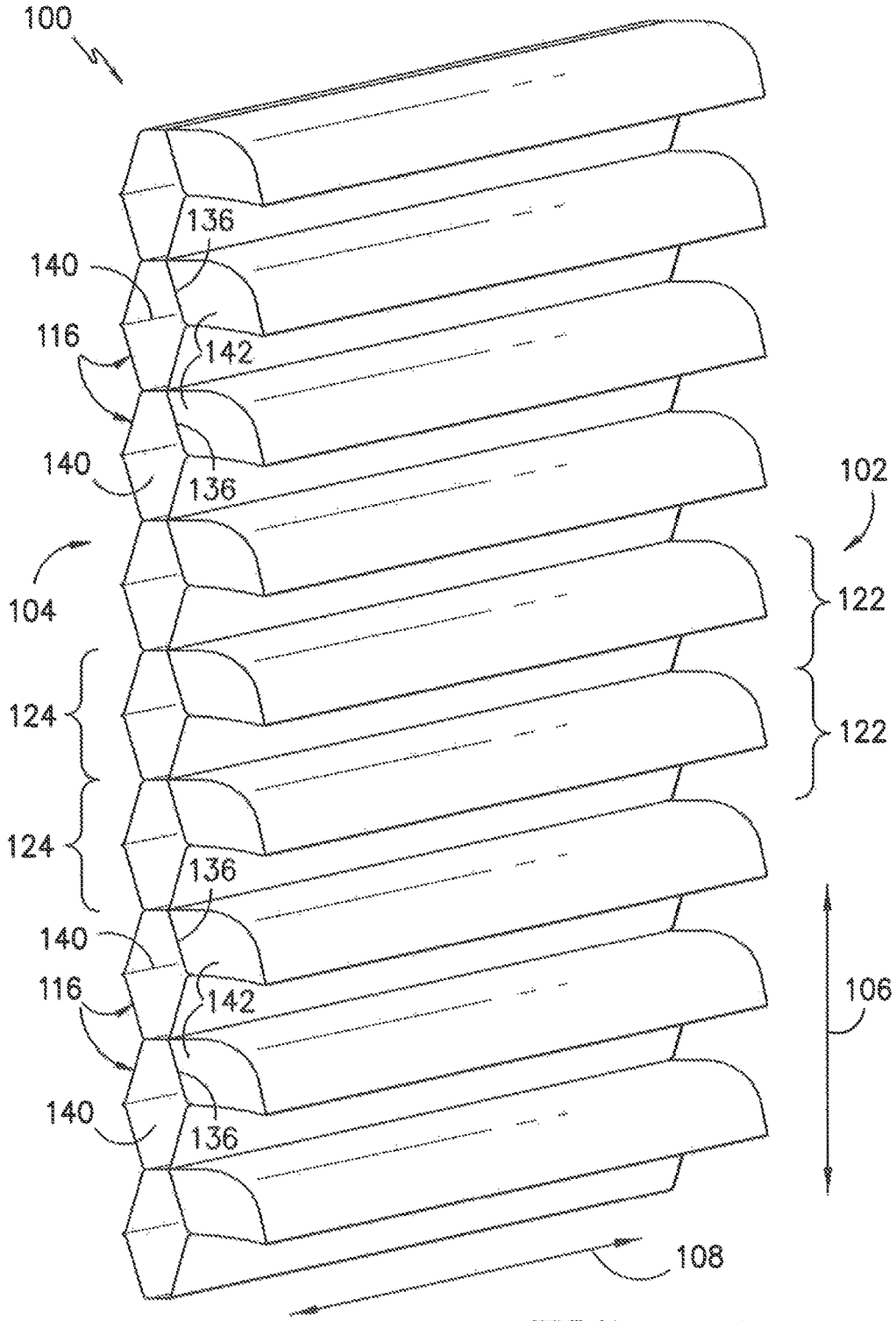
FIG. 1 illustrates a partial, front perspective view of one embodiment of a cellular shade having a plurality of vertically aligned shade cells and a single divider web dividing each shade cell into two separate cell structures in accordance with aspects of the present subject matter, particularly illustrating the cellular shade in an expanded or extended position.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

In general, the present subject matter is directed to an extendable and retractable cellular shade that can be mounted in an architectural opening, such as a window or door, for blocking light, providing privacy, increasing the aesthetic appeal of a room and/or allowing a desired amount of light into a room. Specifically, in several embodiments, the cellular shade may include a plurality of shade cells stacked vertically one on top of the other, with each shade cell being joined or coupled to adjacent shade cells at first and second junction lines. Each shade cell may generally be formed by one or more cell webs extending between the first and second junction lines so as to define a closed shape forming the outer perimeter of the shade cell. For instance, in one embodiment, a first cell web may be configured to extend between the first and second junction lines along a rear side of each shade cell so as to define a rear face of the cellular shade and a second cell web may be configured to extend between the first and second junction lines along a front side of each shade cell so as to define a front face of the cellular shade Additionally, in several embodiments, one or more divider webs may be configured to extend within the interior of the closed shape defined by each shade cell in order to divide the shade cell into two or more separate cell structures. For instance, by including a single divider web coupled at its ends at separate locations around the inner perimeter of each shade cell, each shade cell may be divided into two separate cell structures (e.g., a first cell structure and a second cell structure). Similarly, by including two or three divider webs coupled at their ends at separate locations around the inner perimeter of each shade cell, each shade cell may be divided into three or four separate cell structures, respectively.

As will be described below, a plurality of different design parameters, such as the attachment location(s) at which the ends of each divider web are coupled around the inner perimeter of each shade cell, the length and/or orientation of each divider web within each shade cell, the length and/or number of wall segments defining the sides of each shade cell and/or any other suitable design parameters, may be varied or adjusted to alter the overall configuration of the cellular shade. For example, by carefully selecting such design parameters, the size, shape and/or overall configuration of each corresponding cell structure may be tailored to provide the specific aesthetic look and feel desired for the cellular shade.

Moreover, various design parameters, including, but not limited to, the length and/or orientation of each divider web within each shade cell and/or the material used to form each divider web, may also be varied or adjusted to tailor the light transmission properties of the cellular shade. For instance, each divider web may be formed from a material(s) that allows for less light transmission than the material(s) used to form the cell web(s) defining each shade cell. As such, when the cellular shade is moved to its extended position, the divider web(s) may, for example, be configured to be oriented within each shade cell such that the cellular shade has alternating bands of high and low light transmission. Alternatively, the divider web(s) may be configured to be oriented within each shade cell and/or positioned relative to one another within each shade cell such that all or significant portion of the light hitting the cellular shade is prevented from passing through the shade. For instance, by forming each divider web from a blackout material and by positioning the divider webs relative to one another such that all light hitting the cellular shade is required to pass through at least one of the divider webs, the disclosed cellular shade may be configured to function as a blackout shade when in the extended position.

Given the ability to vary such design parameters, a significant number of different shade configurations may be created, thereby allowing manufacturers to provide consumers with various design options. For instance, the design parameters may be specifically tailored to provide a cellular shade having cell structures defining unique shapes and/or sizes and/or having unique light transmission properties in order to satisfy consumer demands.

It should be appreciated that, as used herein, the term "web" generally refers to any material suitable for use within a cellular shade, including, but not limited to, woven fabrics, non-woven fabrics, knitted fabrics, films and/or laminations of any such material(s). In addition, the webs may be flexible or semi-rigid. A flexible web is formed from a material that is capable of being folded or flexed, such as woven, knitted or non-woven fabrics, vinyl or film sheets, cords of natural or synthetic fibers, monofilaments, and the like. A semi-rigid web, on the other hand, is formed from a material that is somewhat stiffer, but is still flexible or foldable to some degree.

It should also be appreciated that the disclosed cellular shades will generally be described herein as having a horizontal shade configuration such that the shade cells extend lengthwise in the horizontal direction and the shade is configured to be extended and retracted in the vertical direction (e.g., using a lift cord or other suitable device). However, one of ordinary skill in the art should readily appreciate that the disclosed cellular shades may also be utilized in a vertical shade configuration such that the shade cells extend lengthwise in the vertical direction and the shade is configured to be extended and retracted in the horizontal direction (e.g., using a vertical blind tract or other suitable device). Thus, when the disclosed cellular shades are used as vertical shades, it should be appreciated that the directional references used herein may refer to the shade(s) rotated 90 degrees.

Figure 2:
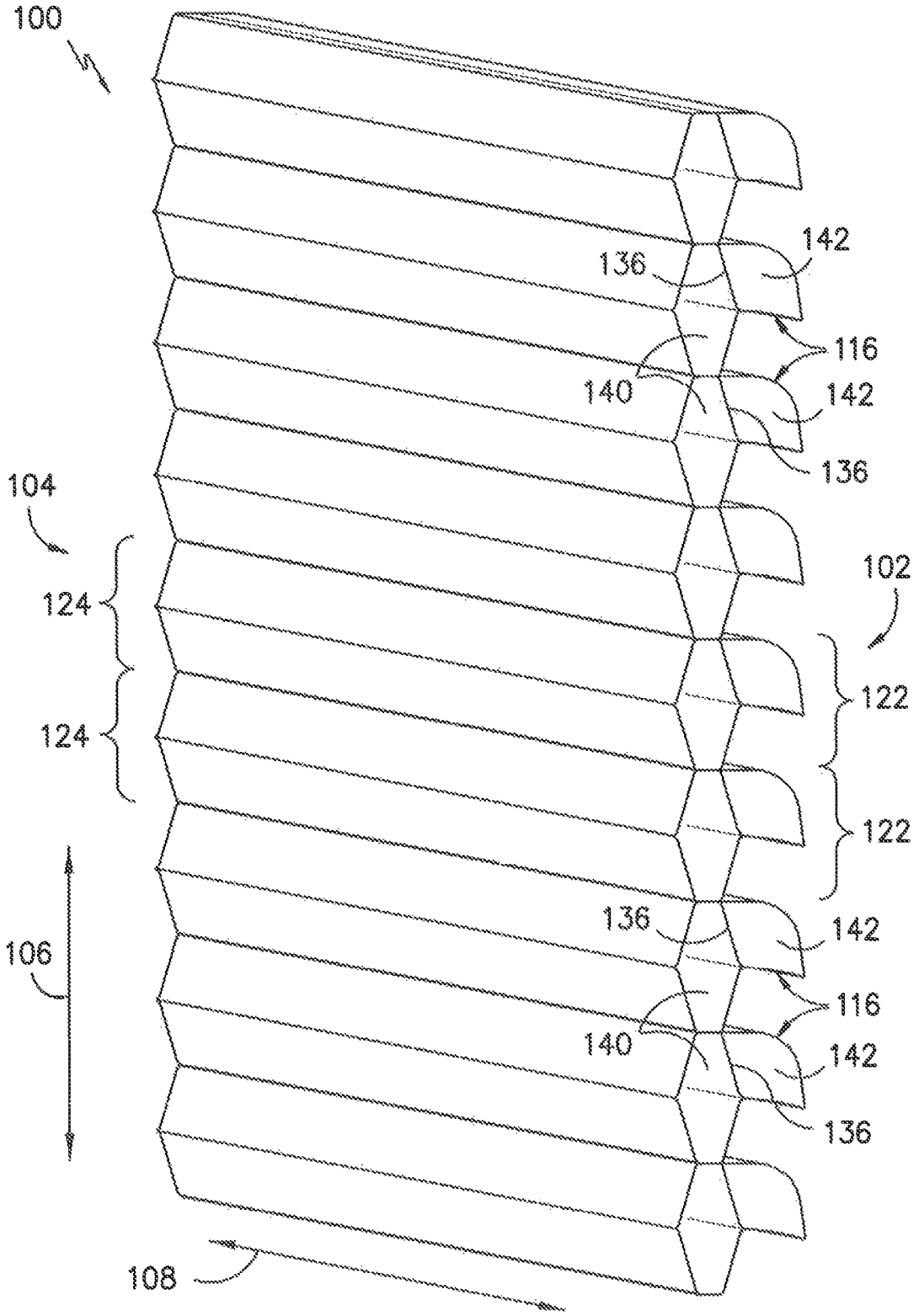
FIG. 2 illustrates a rear perspective view of the cellular shade shown in FIG. 1.
Figure 3:
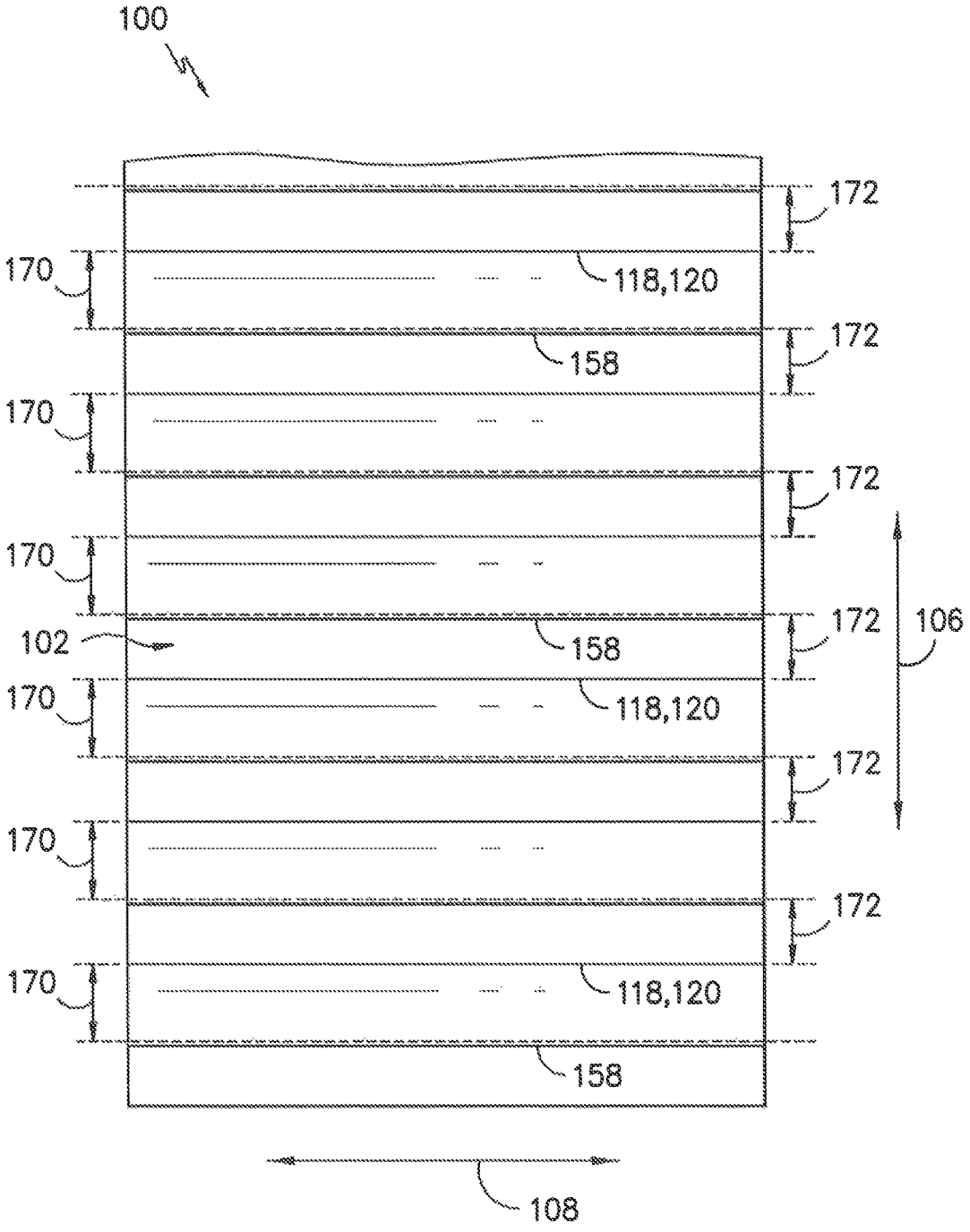
FIG. 3 illustrates a front view of the cellular shade shown in FIG. 1.
Figure 4:
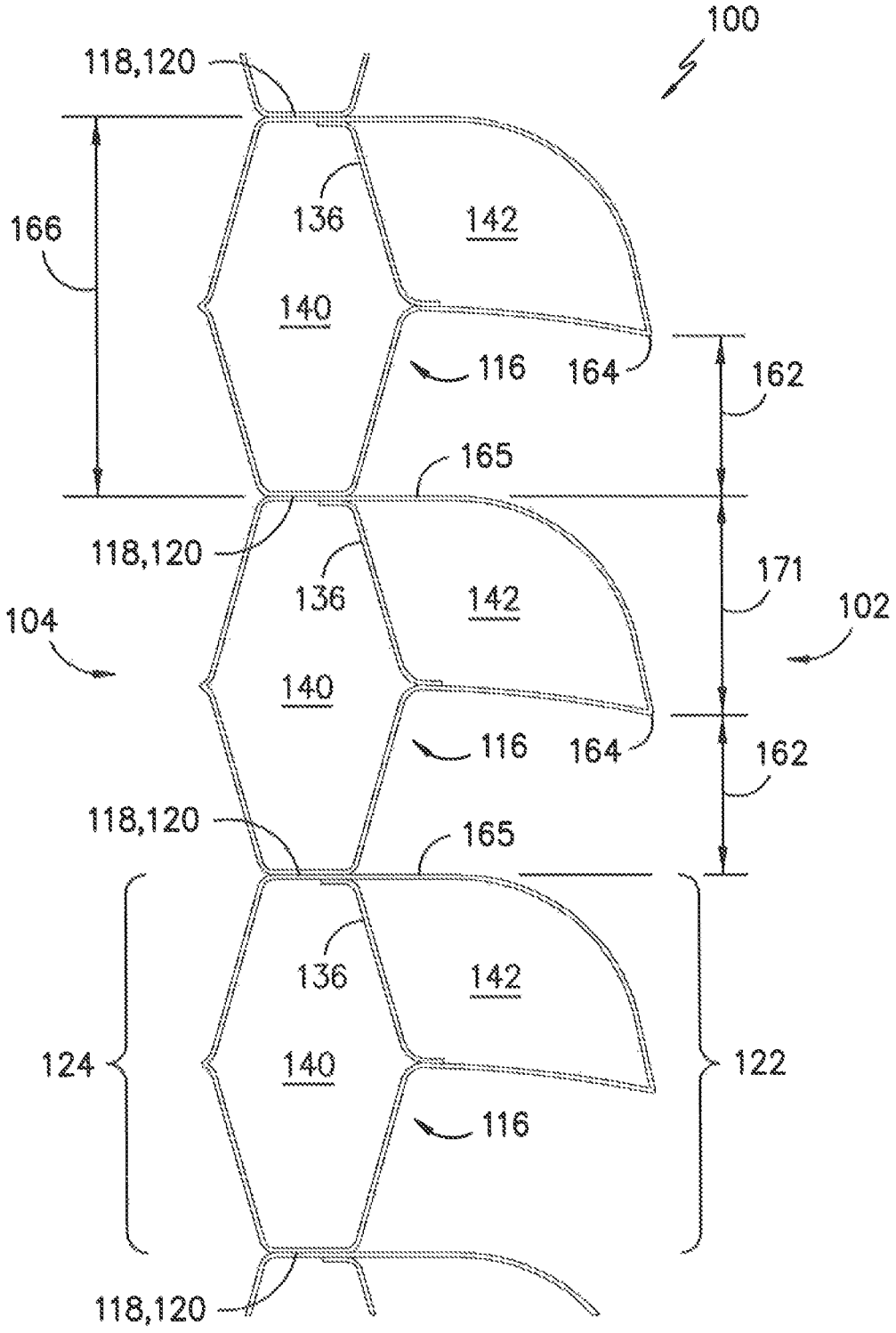
FIG. 4 illustrates a partial side view of the cellular shade shown in FIG. 1.
Figure 5:
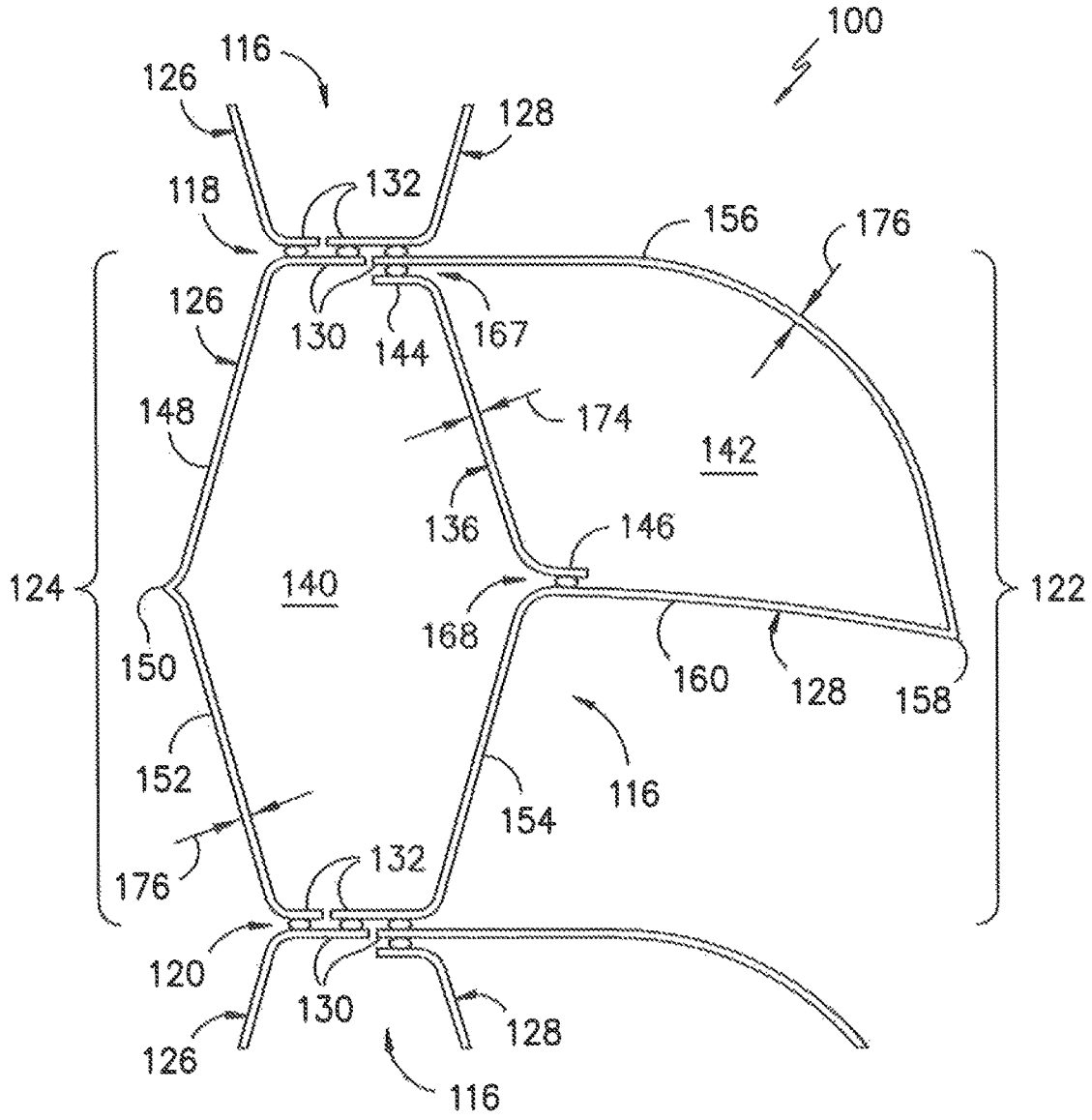
FIG. 5 illustrates a close-up side view of a portion of the cellular shade shown in FIG. 4, particularly illustrating a shade cell of the cellular shade formed from two separate cell webs coupled to adjacent shade cells at first and second junction lines.

Referring now to the drawings, FIGS. 1-6 illustrate several views of one embodiment of a portion of an extendable and retractable cellular shade 100 in accordance with aspects of the present subject matter. Specifically, FIGS. 1 and 2 illustrate front and rear perspective views, respectively, of a portion the cellular shade 100 in an expanded or extended position. FIGS. 3 and 4 illustrate front and side views, respectively, of a portion of the cellular shade 100 shown in FIGS. 1 and 2. FIG. 5 illustrates a magnified view of a portion of the cellular shade 100 shown in FIG. 4. Additionally, FIG. 6 illustrates a front perspective view of the cellular shade 100 shown in FIG. 1 after the shade was moved from the extended position to a retracted position.

It should be appreciated that, in general, the cellular shade 100 may be configured to be mounted within a window or other architectural opening as may be desired. For instance, in one embodiment, the cellular shade 100 may be placed in operative association with a head rail assembly, blind tract assembly or any other suitable device that is configured to be mounted within an architectural opening. However, it should also be understood that the cellular shade 100 is not limited in its particular use as a window or door shade, and may be used in any application as a covering, partition, shade, or the like in any type of architectural opening in a building or structure.

As shown in the illustrated embodiment, the cellular shade 100 may be movable between an extended position (FIGS. 1-5) and a retracted position (FIG. 6). When extended, the cellular shade 100 may generally define a front face 102 and a rear face 104 configured to extend both in a heightwise direction (indicated by arrow 106 in FIGS. 1-3) a given distance (e.g., any distance along the height of the architectural opening within which the cellular shade 100 is installed) and in a widthwise direction (indicated by arrow 108 in FIGS. 1-3) a given distance (e.g., a distance corresponding to the width of the architectural opening within which the cellular shade 100 is installed). It should be appreciated that the terms "front" and rear" are generally used herein simply to distinguish opposite sides or faces of the cellular shade 100, itself, and/or to distinguish opposite sides or faces of components or features of the cellular shade 100. Thus, one of ordinary skill in the art should readily appreciate that the front face 102 of the cellular shade 100 may correspond to either the side of the cellular shade 100 designed to face towards the interior of the room within which the shade is installed or the side of the cellular shade 100 designed to face away from the interior of such room. However, for purposes of description, the front face 102 will be described herein as the side of the cellular shade 100 designed to face towards the interior of the room within which the shade is installed.

Additionally, when retracted, the cellular shade 100 may generally be configured to be collapsed into a stack defining a substantially flat profile. For example, as particularly shown in FIG. 6, the stack formed by the collapsed or retracted cellular shade 100 may generally define a substantially constant height 110 extending across a cross-wise dimension 112 of the stacked cellular shade 100. In such an embodiment, the height 110 of the stack may be "substantially constant" if the height at each location along the crosswise dimension 112 varies by less than 10%, such as less than 5% or less than 2.5% or less than 1%.

It should be appreciated that the cellular shade 100 may include and/or may be associated with any suitable device(s) configured to assist in moving the shade 100 between the extended and retracted positions. For instance, when configured as a horizontal shade, the cellular shade 100 may, in one embodiment, include lift cords (not shown) associated with a rail assembly (not shown) for vertically moving the shade 100 between the extended and retracted positions. In such an embodiment, the lift cords may be configured to extend through the interior of the cellular shade 100. In this manner, the lift cords may be integrated into the product and not left exposed on a surface of the product, thereby providing the cellular shade 100 with a more aesthetically pleasing look. In addition, such hidden or integrated lift cords may also significantly reduce and/or eliminate the child safety risks typically associated with lift cords. Similarly, when configured as a vertical shade, the cellular shade may be configured to be in operative association with a vertical blind tract or any other suitable device for horizontally moving the shade 100 between the extended and retracted positions.

As shown in the illustrated embodiment, the cellular shade 100 may generally include a plurality of vertically aligned shade cells 116 stacked one on top of the other. In general, the shade cells 116 may be configured to have an extended or open cross-sectional configuration when the cellular shade 100 is moved to the extended position (e.g., as shown in FIGS. 1, 2 and 4) and a retracted or flat cross-sectional configuration when the cellular shade 100 is moved to the retracted position (e.g., as shown in FIG. 6).

As shown in FIGS. 4 and 5, when extended, each shade cell 116 may generally be configured to define a closed shape or perimeter extending heightwise between a first junction line 118 and a second junction line 120, with the first and second junction lines 118, 120 generally defining boundary lines between each shade cell 116 its adjacent shade cells 116. For instance, as particularly shown in FIG. 5, the first junction line 118 may define a boundary line between a particular shade cell 116 and the shade cell 116 located immediately above such shade cell 116 while the second junction line 120 may define a boundary line between the particular shade cell 116 and the shade cell 116 located immediately below such shade cell 116. Additionally, each shade cell 116 may define a front side 122 and a rear side 124 extending between the first and second junction lines 118, 120. As particularly shown in FIGS. 1 and 2, the front side 122 of each shade cell 116 may generally be configured to define a portion of the front face 102 of the cellular shade 100 while the rear side 124 of each shade cell 116 may generally be configured to define a portion of the rear face 104 of the cellular shade 100.

It should be appreciated that, in several embodiments, each shade cell 116 may be formed by two or more cell webs extending between the first and second junction lines 118, 120 so as to define the perimeter of the cell 116. For example, as particularly shown in FIG. 5, each shade cell 116 may be formed by a first cell web 126 configured to extend between the first and second junction lines 118, 120 so as to define the rear side 124 of the shade cell 116 and a second cell web 128 configured to extend between the first and second junction lines 118, 120 so as to define the front side 122 of the shade cell 116. In such an embodiment, the first and second cell webs 126, 128 of each shade cell 116 may be configured to be coupled to the first and second cell webs 126, 128 of adjacent shade cells 116 using an offset attachment configuration. For example, both the first cell web 126 and the second cell web 128 may include a top joint portion 130 defined at the first junction line 118 and a bottom joint portion 132 defined at the second junction line 120. As particularly shown in FIG. 5, the top joint portion 130 of the first cell web 126 may be configured to extend across and/or overlap both the bottom joint portion 132 of the adjacent first cell web 126 and the bottom joint portion 132 of the adjacent second cell web 128, thereby allowing the first cell web 126 to be coupled (e.g., via a suitable adhesive) at the first junction line 118 to both of the cell webs forming the adjacent upper shade cell 116. In doing so, the top joint portion 130 of the second cell web 128 may only be configured to be coupled to the bottom joint portion 132 of the adjacent second cell web 128 at the first junction line 118. However, as shown in FIG. 5, at the opposite end of the shade cell 116, the bottom joint portion 132 of the second cell web 128 may be configured to extend across and/or overlap both the top joint portion 130 of the adjacent second cell web 128 and the top joint portion 130 of the adjacent first cell web 126, thereby allowing the second cell web 128 to be coupled (e.g., via a suitable adhesive) at the second junction line 120 to both of the cell webs forming the adjacent lower shade cell 116. In doing so, the bottom joint portion 132 of the first cell web 126 may only be configured to be coupled to the top joint portion 130 of the adjacent first cell web 126 at the second junction line 120.

It should be appreciated that, in other embodiments, the first and second cell webs 126, 128 of each shade cell 116 may be configured to be coupled to one another and/or to the cell webs 126, 128 of adjacent shade cells 116 using any other suitable attachment configuration.

It should also be appreciated that, by forming each shade cell 116 from two separate cell webs, the front face 102 of the cellular shade 100 may be formed from a material that differs from the material used to form the rear face 104 of the cellular shade 100. For example, the cell webs forming the front face 102 (e.g., the second cell webs 128 of FIG. 5) may be made from a material that does not permit significant amounts of light to pass through the material, while the cell webs forming the rear face 104 (e.g., the first cell webs 126 of FIG. 5) may be made from a material that allows much larger quantities of light to pass through the material. In this manner, the front face 102 of the cellular shade 100 may appear to illuminate when the shade 100 is in the extended position and light is striking the shade 100 from the back side. Similarly, when the front face 102 corresponds to the side of the cellular shade 100 facing the interior of the room within which the shade 100 is installed, the cell webs forming the front face 102 may, for example, be formed from a material having an aesthetically pleasing design or texture. In such an embodiment, since the rear face 104 of the cellular shade 100 may not be typically viewed, the cell webs forming the rear face 104 may be formed from a material that is less ornate and, thus, less expensive, thereby reducing the overall cost of manufacturing the cellular shade 100.

Additionally, it should be appreciated that, in alternative embodiments, each shade cell 116 may be formed by a single web extending between the first and second junction lines 118, 120. An example of such a configuration is provided in FIG. 7. As shown, each shade cell 116 includes a single web 127 that is looped between the first and second junction lines 118, 120 so as to define both the front and rear sides 122, 124 of the shade cell 116. Specifically, the looped web 127 may be configured to extend between a first web end 129 and a second web end 131, with the ends 129, 131 of the looped web 127 being coupled to the web 127 of an adjacent shade cell 116 at one of the junction lines (e.g., the first junction line 118). In such an embodiment, the looped web 127 may be coupled to the web 127 of the other adjacent shade cell 116 at a given location between its first and second web ends 129, 131 so as to define the other junction line (e.g., the second junction line 120).

Referring back to FIGS. 1-6, in several embodiments, each shade cell 116 may include one or more divider webs 136 extending therein so as to divide the shade cell 116 into two or more cell structures. For instance, as shown in the illustrated embodiment, each shade cell 116 includes a single divider web 136, thereby dividing the shade cell 116 into two separate cell structures 140, 142. However, in alternative embodiments, any other suitable number of divider webs may be configured to extend within the interior of each shade cell 116, such as two divider webs (e.g., as shown in FIGS. 12 and 13), three divider webs (e.g., as shown in FIGS. 14 and 15) or four or more divider webs.

Each divider web 136 may generally be configured to be coupled to the inner surface of its corresponding shade cell 116 at two separate attachment locations. For instance, as particularly shown in FIG. 5, each divider web 136 may be configured to extend between a first divider end 144 and a second divider end 146, with the first divider end 144 being coupled to the inner surface of the corresponding shade cell 116 at a first attachment location (e.g., via a suitable adhesive) so as to define a first joint line 167 between the shade cell 116 and the divider web 136 and the second divider end 146 being coupled to the inner surface of the corresponding shade cell 116 at a second attachment location (e.g., via a suitable adhesive) so as to define a second joint line 168 between the shade cell 116 and the divider web 136.

As shown in the illustrated embodiment, due to the inclusion of a single divider web 136 within each shade cell 116, the cellular shade 100 may be divided into a plurality of vertically aligned first cell structures 140 and a plurality of vertically aligned second cell structures 142. In general, each first cell structure 140 may form a closed-shape defining first and second sides extending heightwise between the first and second junction lines 118, 120. As particularly shown in FIG. 5, the first side of each first cell structure 140 may generally be formed by a first upper wall segment 148 extending between the first junction line 118 and a fold or crease line 150 and a first lower wall segment 152 extending between the crease line 150 and the second junction line 120. In such an embodiment, the first upper and lower wall segments 148, 152 of each first cell structure 140 may generally form all or a portion the rear side 124 of its corresponding shade cell 116 and, thus, may define a portion of the rear face 104 of the cellular shade 100.

Additionally, the second side of each first cell structure 140 may generally include an upper portion formed by the divider web 136 and a lower portion formed by a second lower wall segment 154 extending between the second joint line 168 and the second junction line 120. As shown in FIG. 5, due to the configuration of the cellular shade 100, the second lower wall segment 154 of each first cell structure 140 may generally be configured to form a portion of the front side 122 of its corresponding shade cell 116 and, thus, may define a portion of the front face 102 of the cellular shade 100. Accordingly, each first cell structure 140 may define portions of both the front and rear faces 102, 104 of the cellular shade 100.

Moreover, as particularly shown in FIG. 5, each second cell structure 142 may generally define a closed shape having a first side formed by the divider web 136 and a second side extending outwardly from the adjacent first cell structure 140. Specifically, as shown, the first side of each second cell structure 142 may generally be defined between the first and second divider ends 144, 146 of the divider web 136. Thus, each divider web 136 may form a common wall segment defining both the first side of each second cell structure 142 and the upper portion of the second side of each first cell structure 140.

Additionally, as shown in the illustrated embodiment, the second side of each second cell structure 142 may be formed by a first wall segment 156 extending between the first junction line 118 and a fold or crease line 158 and a second wall segment 160 extending between the crease line 158 and the second joint line 168. As particularly shown in FIG. 5, the first and second wall segments 156, 160 of each second cell structure 142 in combination with the second lower wall segment 154 of each first cell structure 140 may generally define the front side 122 of each corresponding shade cell 116. Thus, it should be appreciated that the front face 102 of the cellular shade 100 may be defined partially by the second side of each second cell structure 142 and partially by the second lower wall segment 154 of each first cell structure 140.

By configuring the cellular shade 100 in the manner shown in the illustrated embodiment, the second cell structures 142 may be spaced apart vertically along the heightwise direction 106 of the cellular shade 100. Specifically, as shown in FIG. 4, a vertical gap 162 may be defined between the vertical ends 164, 165 of each second cell structure 142 and the vertical ends 164, 165 of adjacent second cell structures 142. As used herein, the term "vertical ends" generally corresponds to the uppermost and lowermost points defined by each cell structure. Thus, as shown in FIG. 4, for a given second cell structure 142, a first vertical gap 162 may be defined between its lower vertical end 164 (i.e., its lowermost point) and the upper vertical end 165 of the adjacent second cell structure 116 disposed immediately below such second cell structure 142 while a second vertical gap 162 may be defined between its upper vertical end 165 (i.e., its uppermost point) and the lower vertical end 164 of the adjacent second cell structure 142 disposed immediately above such second cell structure.

It should be appreciated that the vertical gap 162 may generally correspond to any suitable distance. However, in several embodiments, the vertical gap 162 may correspond to a distance equal to less than 75% of a height 166 (FIG. 4) of each first cell structure 140, such as a distance equal to less than 60% of the height 166 or less than 50% of the height 166 or less than 40% of the height 166.

Additionally, it should be appreciated that the size and/or shape of the cell structures 140, 142 formed by the inclusion of the divider web 136 within each shade cell 116 may generally vary depending on one or more design parameters, such as the positioning of the attachment locations for each divider web 136, the length of each divider web 136 and/or the overall length and/or number of the wall segments forming the sides 122, 124 of each shade cell 116. For instance, as shown in the illustrated embodiment, the divider web 136 is generally coupled to the cell web forming the front side 122 of each shade cell 116 (e.g., cell web 128 (FIG. 5) or cell web 127 (FIG. 7)). Specifically, as shown in FIG. 5, the first divider end 144 is coupled the second cell web 128 at a location generally ad scent to the front side of the first junction line 118 and the second divider end 146 is coupled to the second cell web 128 at a location between the first and second junction lines 118, 120 such that the second joint line 168 is generally vertically aligned with the crease line 150 defined along the rear side 124 of the shade cell 116 when the cellular shade 100 is in the extended position. As such, each first cell structure 140 may generally be configured to define the elongated honeycomb cross-sectional shape shown in the illustrated embodiment.

In addition, the overall length of the front side 122 of each shade cell 116 (i.e., the combined length of the first wall segment 156, the second wall segment 160 and the second lower wall segment 154) is significantly greater than the overall length of the rear side 124 of each shade cell 116 (i.e., the combined length of the first upper and lower wall segments 148, 152), thereby allowing for the formation of the second cell structures 142 along the front face 102 of the cellular shade 104. For instance, due to the increased length of the front side 122 of each shade cell 116, each second cell structure 142 may define a cross-sectional area that is greater than 30% of the cross-sectional area defined by each first cell structure 140, such as by defining a cross-sectional area that is greater than 40% of the cross-sectional area defined by each first cell structure 140 or greater than 50% of the cross-sectional area defined by each first cell structure 140 or greater than 60% of the cross-sectional area defined by each first cell structure 140. However, in other embodiments, the cross-sectional area defined by each second cell structure 142 may be less than 30% of the cross-sectional area defined by each first cell structure 140.

Additionally, as shown in FIG. 4, due to the illustrated shade configuration, each second cell structure 142 may define a height 171 that is less than the height 166 of each first cell structure 140. For instance, in one embodiment, the height 171 may be equal to less than 70% of the height 166, such as less than 60% of the height 166 or less than 50% of the height 166 or less than 40% of the height 166. Moreover, by forming the second side of each second cell structure 142 with two wall segments 156, 160 divided by a single crease line 158 and by configuring the upper wall segment 156 to be longer than the lower wall segment 160, each second cell structure 142 may generally be configured to define the "talon-shaped" cross-section shown in the illustrated embodiment. However, as will be described below, by adjusting the various design parameters associated with the cellular shade 100, the configuration of the corresponding cell structures 140, 142 may differ significantly than that shown in FIGS. 1-7.

It should be appreciated that the divider webs 136 may generally be formed from any suitable material(s). However, in several embodiments, it may be desirable to form the divider webs 136 from a material(s) having a lower light transmittance value than the material(s) used to form each shade cell 116 (e.g., the material(s) forming each cell web(s)). For instance, the divider webs 136 may be formed from a material(s) that allows for the transmission of at least 10% less light than that of the material(s) forming the cell web(s), such as by using a material(s) that allows for at least 25% less light transmission or at least 50% less light transmission or at least 75% less light transmission or at least 100% less light transmission. In a particular embodiment, the divider webs 136 may be formed from a material(s) that allows for significantly less light transmission than that of the material(s) forming the web(s), such as by using a material(s) that allows for at least 150% less light transmission or at least 200% less light transmission or at least 250% less light transmission. For example, the divider webs 136 may be formed from a blackout material(s) that completely or substantially prevents all light from passing through each divider web 136.

It should be appreciated that the light transmittance value associated with a given web generally refers to the ratio of the amount of light (e.g., visible light having wavelengths from 380 to 780 nanometers and/or ultraviolet light having wavelengths from 300 to 380 nanometers) that is allowed to pass through the web to the amount of total light hitting or striking the web. Additionally, as is generally understood, the light transmittance value for a web may be determined using various known measurement techniques and/or methodologies. For example, in one embodiment, a light source emitting a known amount of light may be placed a given distance from one side of a web and a light meter may be placed a given distance from the other side of the web. The light meter may then be used to measure the amount of light transmitted through the web, which may then be used to calculate its light transmittance value.

Given the positioning of the divider webs 136 shown in the illustrated embodiment and by configuring the divider webs 136 to provide for lower light transmissions than that of the remainder of the cellular shade 100, a plurality of alternating light transmission bands may be formed along the heightwise direction 106 of the shade 100. For example, as shown in FIG. 3, when in the extended position, the cellular shade 100 may include a plurality of first light transmission bands 170 extending heightwise along the shade 100 at the locations of the divider webs 136, with top of each first light transmission band 170 being defined at the vertical location of the first divider end 144 of each divider web 136 and the bottom of each first light transmission band 170 being defined at the vertical location of the second divider end 146 of each divider web 136. Additionally, as shown in FIG. 3, the cellular shade 100 may include a plurality of second light transmission bands 172 extending between each pair of adjacent first light transmission bands 170 such that alternating rows of first and second light transmission bands 170, 172 extend vertically along the shade 100 in the heightwise direction 106. In such an embodiment, by forming the divider webs 136 from a material(s) having a lower light transmittance value than the material(s) forming the cell web(s), less light may be transmitted through the cellular shade 100 at the locations of the first light transmission bands 170 than at the locations of the second light transmission bands 172, thereby providing a unique illumination design/effect for the shade 100. For instance, when viewing the front face 102 of the cellular shade 100 as light is hitting the rear face 104, the second lower wall segment 154 of each first cell structure 140 may appear significantly more illuminated than the wall segments 156, 160 forming the second side of each second cell structure 142.

It should be appreciated that the relative vertical heights of the first and second light transmission bands 170, 172 may generally very depending on the length of each divider web 136 as well as the orientation of the divider webs 136 within the shade cells 116 when the cellular shade 100 is in the extended position. However, in one embodiment, the height of each first light transmission band 170 may be substantially equal to the height of each second light transmission band 172. Alternatively, the height defined by each first light transmission band 170 may be greater than or less than the height defined by each second light transmission band 172.

It should also be appreciated that the relative amounts of light allowed to pass through the first and second light transmission bands 170, 172 may also vary depending on the material(s) used to form the divider webs 136 and/or the material(s) used to form the cell web(s). However, in one embodiment, the first light transmission bands 170 may be configured to transmit at least 25% less light than the second light transmission bands 172, such as by configuring the first light transmission bands 170 to transmit at least 50% less light than the second light transmission bands 172 or at least 100% less light than the second light transmission bands 172 or at least 150% less light than the second light transmission bands 172 or at least 200% less light than the second light transmission bands 172.

Additionally, in several embodiments, a width 174 (FIG. 5) of each divider web 136 may differ from a width 176 (FIG. 5) of the cell web(s) used to form each shade cell 116. Specifically, in a particular embodiment, the width 174 of each divider web 136 may be equal to less than about 50% of the width 176 of the cell web(s), such as less than about 25% of the width 176 of the cell web(s) or less than about 10% of the width 176 of the cell web(s). By configuring the width 174 of each divider web 136 to be a relatively small fraction of the overall width 176 of each cell web, it can be ensured that the cellular shade 100 defines a substantially flat profile when the shade 100 is moved to the retracted position.

As indicated above, various different shade configurations may be formed by adjusting the design parameters associated with a particular cellular shade. For instance, FIGS. 8 and 9 illustrate partial side views of another embodiment of a cellular shade 200 in accordance with aspects of the present subject matter. In general, the cellular shade 200 may be configured similar to the cellular shade 100 described above. For example, the shade 200 may include a plurality of vertically aligned shade cells 216, with each shade cell 216 being coupled to adjacent shade cells 216 at a first junction line 218 and a second junction line 220. In addition, each shade cell 216 may include a front side 222 defining a portion of a front face 202 of the cellular shade 200 and a rear side 224 defining a portion of a rear face 204 of the cellular shade 200, with each side 222, 224 being formed from a separate cell web (e.g., as shown in FIG. 9) or from a single looped web (e.g., similar to that shown in FIG. 7). Moreover, each shade cell 216 includes a divider web 236 extending therein so as to divide the cell 216 into a first cell structure 240 and a second cell structure 242.

Similar to the first cell structures 140 described above with reference to FIGS. 1-7, each first cell structure 240 may include a first side formed at least partially by wall segments 248, 252 (FIG. 9) extending from the first and second junction lines 218, 220 to a fold or crease line 250 (FIG. 9) and a second side formed at least partially by the divider web 236 and a lower wall segment 254 (FIG. 9). As shown in the illustrated embodiment, the first side of each first cell structure 240 may be configured to define a portion of the rear face 204 of the cellular shade 200 while a portion of the second side of each first cell structure 240 (i.e., the lower wall segment 254) may be configured to partially define the front face 202 of the cellular shade 200. Additionally, each second cell structure 242 may include a first side formed by the divider web 136 and a second side formed at least partially by one or more wall segments. For example, as shown in FIG. 9, the second side of each second cell structure 242 may include a first wall segment 256 and a second wall segment 260 extending from a fold or crease line 258. As shown in the illustrated embodiment, the second side of each second cell structure 242 together with the lower wall segment 254 of each first cell structure 240 may generally define the front face 202 of the cellular shade 100.

However, in contrast to the embodiment described above, the overall length of the front side 222 of each shade cell 216 (e.g., the combined length of the lower wall segment 254 and the first and second wall segments 256, 260) is substantially equal to the overall length of the rear side 224 of each shade cell 216 (e.g., the combined length of the wall segments 248, 252). Additionally, as opposed to coupling the divider web 236 at attachment locations defined along the front side 222 of each shade cell 216, the divider web 236 extends between the front and rear sides 222, 224 of each shade cell 216 (e.g., from the wall segment 248 on the rear side 224 of each shade cell 216 to the intersection of the lower wall segment 254 and the second wall segment 260 defined on the front side 222 of each shade cell 216). Thus, when the cellular shade 200 is moved to the extended position, each divider web 236, together with the lower wall segment 254 of each first cell structure 240 and the junction lines 218, 220 defined between adjacent shade cells 216, may be vertically orientated along the heightwise direction of the cellular shade 200 such that a vertically extending wall is defined between the front and rear sides 222, 224 of each shade cell 216 from which the first and second cell structures 240, 242 extend. Additionally, as shown in the illustrated embodiment, such a configuration may result in each first cell structure 240 defining a tear-drop cross-sectional shape and the second cell structure 242 defining an inverse tear-drop cross-sectional shape. In addition, the illustrated configuration may also result in the first and second cell structures 240, 242 defining substantially equal cross-sectional areas.

Moreover, as shown in FIG. 8, due to the configuration of the cellular shade 200, both the first and second cell structures 240, 242 may be spaced apart vertically along the heightwise direction of the cellular shade 200. Specifically, the first cell structures 240 may be spaced apart from one another such that vertical gaps 261 are defined between the vertical ends of each adjacent pair of first cell structures 240. Similarly, the second cell structures 242 may be spaced apart from one another such that vertical gaps 262 are defined between the vertical ends of each adjacent pair of second cell structures 242.

It should be appreciated that, similar to the embodiment described above with reference to FIGS. 1-7, the divider webs 236 may be utilized to define alternating light transmission bands along the heightwise direction of the cellular shade 200 when the shade 200 is in the extended position. For example, as shown in FIG. 8, a first light transmission band 270 may be defined along the vertical length of each divider web 236, with second light transmission bands 272 being defined between each pair of adjacent first light transmission bands 270.

As another example of a shade configuration that may be achieved by varying the design parameters associated with a particular cellular shade, FIGS. 10 and 11 illustrate partial side views of yet another embodiment of a cellular shade 300 in accordance with aspects of the present subject matter. In general, the cellular shade 300 may be configured similar to the cellular shades 100, 200 described above. For instance, the cellular shade 300 may include a plurality of vertically aligned shade cells 316, with each shade cell 316 being coupled to adjacent shade cells 316 at a first junction line 318 and a second junction line 320. In addition, each shade cell 316 may include a front side 322 defining a portion of a front face 302 of the cellular shade 300 and a rear side 324 defining a portion of a rear face 304 of the cellular shade 300, with each side 322, 324 being formed from a separate cell web (e.g., as shown in FIG. 11) or from a single looped web (e.g., similar to that shown in FIG. 7). Moreover, each shade cell 316 includes a divider web 336 extending therein so as to divide the shade cell 316 into a first cell structure 340 and a second cell structure 342.

Similar to the first cell structures 140, 240 described above, each first cell structure 340 may include a first side formed at least partially by wall segments 348, 352 (FIG. 11) extending from the junction lines 318, 320 to a fold or crease line 350 (FIG. 11) and a second side formed at least partially by the divider web 336 and a lower wall segment 354 (FIG. 11). As shown in the illustrated embodiment, the first side of each first cell structure 340 may be configured to define a portion of the rear face 304 of the cellular shade 300 while a portion of the second side of each first cell structure 340 (i.e., the lower wall segment 354) may be configured to partially define the front face 302 of the cellular shade 300. Additionally, each second cell structure 342 may include a first side formed by the divider web 336 and a second side extending outwardly from the divider web 336. As shown in the illustrated embodiment, the second side of each second cell structure 342 together with the lower wall segment 354 of each first cell structure 340 may generally define the front face 302 of the cellular shade 300. Moreover, as particularly shown in FIG. 10, the second cell structures 342 may be spaced apart vertically along the heightwise direction of the cellular shade 300 such that vertical gaps 362 are defined between the vertical ends each adjacent pair of second cell structures 342.

However, in contrast to the embodiment described above with reference to FIGS. 1-7, the second side of each second cell structure 342 is formed by three wall segments 356, 357, 358. Specifically, as shown in FIG. 11, the second side includes a first wall segment 356 extending between the first junction line 318 and a first fold or crease line 359, a second wall segment 357 extending between the first crease line 359 and a second crease line 360 and a third wall segment 358 extending between the second crease line 360 and the lower wall segment 354. In such an embodiment, as opposed to the "talon-shaped" cross-section shown in FIGS. 1-7, each second cell structure 342 may define a substantially rectangular or box-like cross-sectional shape.

Additionally, similar to the embodiments described above, the divider webs 336 may be utilized to define alternating light transmission bands along the heightwise direction of the cellular shade 300 when the shade 300 is in the extended position. For example, as shown in FIG. 10, a first light transmission band 370 may be defined along the vertical length of each divider web 336, with second light transmission bands 372 being defined between each pair of adjacent first light transmission bands 370.

It should be appreciated that the embodiments shown in FIGS. 1-11 simply provide examples of shade configurations that may be provided when a single divider web is used to divide each shade cell into first and second cell structures. However, as described above, various other shade configurations, including differing sizes and/or shapes of the first and/or second cell structures and/or differing light transmission properties, may be achieved by adjusting the design parameters associated with any given cellular shade.

As indicated above, the cellular shades disclosed herein may generally be configured to include any suitable number of divider webs extending within the interior of each shade cell. For example, FIGS. 12 and 13 illustrate partial side views of an embodiment of a cellular shade 400 including two divider webs extending within each shade cell in accordance with aspects of the present subject matter.

In general, the cellular shade 400 may be configured similar to the cellular shades 100, 200, 300 described above. For example, the cellular shade 400 may include a plurality of vertically aligned shade cells 416, with each shade cell 416 being coupled to adjacent shade cells 416 at a first junction line 418 and a second junction line 420. In addition, each shade cell 416 may include a first side 422 defining a portion of a front face 402 of the cellular shade 400 and a second side 424 defining a portion of a rear face 404 of the cellular shade 400, with each side 422, 424 being formed from a separate cell web (e.g., as shown in FIG. 13) or from a single looped web (e.g., similar to that shown in FIG. 7).

Moreover, each shade cell 416 includes a first divider web 436 and a second divider web 437 extending therein so as to divide the shade cell 416 into a first cell structure 440, a second cell structure 441 and a third cell structure 442. As shown in the illustrated embodiment, the first cell structures 440 may generally be vertically aligned with one another along the heightwise direction of the cellular shade 400, with each first cell structure 440 being configured to form a closed-shape defining first and second sides extending between the first and second junction lines 418, 420. As particularly shown in FIG. 13, the first side of each first cell structure 440 may be formed by an upper wall segment 448 and the second divider web 437. Additionally, the second side of each first cell structure 440 may be formed by the first divider web 436 and a lower wall segment 454. As shown in FIGS. 12 and 13, due to the configuration of the cellular shade 400, the upper wall segment 448 of each first cell structure 440 may be configured to define a portion of the rear face 404 of the cellular shade 400 and the lower wall segment 454 of each first cell structure 440 may be configured to define a portion of the front face 402 of the cellular shade 400.

In addition, as shown in the illustrated embodiment, the second cell structures 441 may generally be vertically aligned with one another along the heightwise direction of the cellular shade 400, with each second cell structure 441 having a first side formed by the first divider web 436 and a second side extending outwardly from the adjacent first cell structure 440. Specifically, as shown in FIG. 13, the second side of each second cell structure 441 may be formed by a first wall segment 456 extending between the first junction line 418 and a fold or crease line 458 and a second wall segment 460 extending between the crease line 458 and the lower wall segment 454. Thus, the first and second wall segments 456, 460 of each second cell structure 441 in combination with the lower wall segment 454 of each first cell structure 440 may generally define the front face 402 of the cellular shade 400.

Moreover, as shown in the illustrated embodiment, the third cell structures 442 may generally be vertically aligned with one another along the heightwise direction of the cellular shade 400, with each third cell structure 442 defining a first side and a second side. As shown in FIG. 13, the second side of each third cell structure 442 may be formed by the second divider web 437. Additionally, the first side of each third cell structure 442 may be configured to extend outwardly from the adjacent first cell structure 440 and may be formed by a first wall segment 450 extending between the upper wall segment 448 and a fold or a crease line 451 and a second wall segment 452 extending between the crease line 451 and the second junction line 420. Thus, the first and second wall segments 450, 452 of each third cell structure 442 in combination with the upper wall segment 448 of each first cell structure 440 may generally define the rear face 404 of the cellular shade 400.

Due to the configuration of the illustrated cellular shade 400, the second and third cell structures 441, 442 may be spaced apart vertically along the heightwise direction of the cellular shade 400. Specifically, as shown in FIG. 12, the second cell structures 441 may be spaced apart from one another such that vertical gaps 461 are defined between the vertical ends of each adjacent pair of second cell structures 441. Similarly, the third cell structures 442 may be spaced apart from one another such that vertical gaps 462 are defined between the vertical ends of each adjacent pair of third cell structures 442.

As indicated above, the size and/or shape of the cell structures 440, 441, 442 formed by the inclusion of the divider webs 436, 437 may generally vary depending on the specific design parameters selected for the cellular shade 400, such as the positioning of the attachment locations for each divider web 436, 437, the overall lengths of the divider webs 436, 437 and/or the overall length and/or number of the wall segments forming the sides 422, 424 of each shade cell 416. For example, given the configuration shown in the illustrated embodiment, each first cell structure 440 generally defines a substantially rectangular cross-sectional shape while each second and third cell structure 441, 442 generally defines a substantially "talon-shaped" cross-section. Additionally, each second and third cell structure 441, 442 generally defines a cross-sectional area that is approximately equal to 50% of the cross-sectional are defined by each first cell structure 440. However, it should be appreciated that, in alternative embodiments, cell structures 440, 441, 442 defining any other suitable sizes and/or shapes may be obtained by varying one or more of the design parameters of the cellular shade 400.

It should also be appreciated that the amount of light transmitted through the cellular shade 400 may also be impacted by the relative positioning of the divider webs 436, 437 within each shade cell 416, the overall length defined by each divider web 436, 437 and/or the material(s) used to form the divider webs 436, 437. For instance, as indicated above, each divider web 436, 437 may be formed from a material(s) having a lower light transmittance value than the material(s) used to form the cell web(s). Thus, by carefully selecting the positioning and/or length of the divider webs 436, 437, the illumination effect provided as light passes through the cellular shade 400 may be tailored to provide a desired look and/or feel for the shade 400. For instance, in one embodiment, the first and second divider webs 436, 437 may be positioned relative to one another within each shade cell 416 when the cellular shade 400 is in the extended position such that a bottom end 438 (FIG. 13) of the first divider web 436 is horizontally aligned with a top end 439 of the second divider web 437 (e.g., as shown in FIG. 13). By doing so, a significant portion of the light transmitted through the cellular shade 400 must be directed through one or both of the divider webs 436, 437.

For example, as shown in FIG. 13, light transmitted through the cellular shade 400 in the horizontal direction (e.g., along arrows 480) may be directed through either the first divider web 436 or the second divider web 437. Thus, depending on the material(s) used to form the divider webs 436, 437, a small or large portion of the light hitting the cellular shade 400 may be prevented from passing through the shade 400. However, as shown in FIG. 13, light transmitted diagonally through the first cell structure 440 between the upper wall segment 448 and the lower wall segment 454 (e.g., along line 482) may pass through the cellular shade 400 without being transmitted through one of the divider webs 436, 437. Accordingly, in such an embodiment, a unique illumination effect may be provided, for example, along the front face 402 of the cellular shade 400 at the locations of the lower wall segments 454 as light passes diagonally through the first cell structure 440.

In another embodiment, the first and second divider webs 436, 437 may be positioned relative to one another such that the first and second divider webs 436, 437 horizontally overlap one another when the cellular shade 400 is in the extended position (e.g., by configuring a portion of the first divider web 436 to be extend vertically below the top end 439 of the second divider web 437 so that the first divider web 436 at least partially overlaps the second divider web 437 in the horizontal direction). Such a configuration may allow for an even larger portion of the light transmitted through the cellular shade 400 to be directed through one or both of the divider webs 436, 437. However, the overlapping configuration may also result in some variability in the height of the stack formed when the cellular shade 400 is moved to the retracted position.

In other embodiments, any other suitable illumination or lighting effects may be provided by adjusting the configuration and/or relative positioning of the divider webs 436, 437. For instance, by shortening the length of one or more of the divider webs 436, 437 (e.g., such that the bottom end 438 of the first divider web 436 is located vertically above the top end 439 of the second divider web 437) or by increasing the horizontal distance defined between the divider webs 436, 437, an additional amount of light may be transmitted through the cellular shade 400. Similarly, by increasing the length of one or more of the divider webs 436, 437 so that the amount of horizontal overlap between the webs 436, 437 is increased and/or by reducing the horizontal distance defined between the divider webs 436, 437, the amount of light transmitted through the cellular shade 400 may be reduced.

Referring now to FIGS. 14 and 15, partial side views of an embodiment of a cellular shade 500 including three divider webs extending within each shade cell is illustrated in accordance with aspects of the present subject matter. In general, the cellular shade 500 may be configured similar to the cellular shades 100, 200, 300, 400 described above. For example, the cellular shade 500 may include a plurality of vertically aligned shade cells 516, with each shade cell 516 being coupled to adjacent shade cells 516 at a first junction line 518 and a second junction line 520. In addition, each shade cell 516 may include a front side 522 defining a portion of a front face 502 of the cellular shade 500 and a rear side 524 defining a portion of a rear face 504 of the cellular shade 500, with each side 522, 524 being formed from a separate cell web (e.g., as shown in FIG. 15) or from a single looped web (e.g., similar to that shown in FIG. 7).

Moreover, each shade cell 516 includes a first divider web 536, a second divider web 537 and a third divider web 538 extending therein so as to divide the shade cell 516 into a first cell structure 539, a second cell structure 540, a third cell structure 541 and a fourth cell structure 542. As particularly shown in FIG. 15, when the cellular shade 500 is in the extended position, each third divider web 538 may be configured to form an "S-shape" between the two locations at which the divider web 538 is coupled to its corresponding shade cell 516 (e.g., a first attachment location 590 and a second attachment location 592). As a result, the third divider web 538 may be configured to extend across and/or diagonally between the first and second cell structures 539, 540 so that the divider web 538 contacts the first divider web 536 at a first contact location 594 and the second divider web 537 at a second contact location 596. Thus, when at the extended position, each third divider web 538 may be positioned/oriented within each shade cell 516 such that the first cell structure 539 includes both an upper sub-cell structure 539A and a lower sub-cell structure 539B separated front one another at the second contact location 596 and the second cell structure 540 includes both an upper sub-cell structure 540A and a lower sub-cell structure 540B separated from one another at the first contact location 594.

It should be appreciated that, as used herein, the upper and lower sub-cell structures 539A, 539B will be considered as collectively defining the first cell structure 539 when the cellular shade 500 is in the extended position and the upper and lower sub-cell structures 540A, 540B will be considered as collectively defining the second cell structure 540 when the cellular shade 500 is in the extended position. It should also be appreciated that, in alternative embodiments, the third divider web 538 may be positioned or otherwise configured such that it does not contact the first divider web 536 and/or the second divider web 537. In such embodiments, the first cell structure 539 and/or the second cell structure 540 may not be sub-divided into the corresponding sub-cell structures 539A, 539B, 540A, 540B. For instance, in one embodiment, the third divider web 538 may simply be configured to extend diagonally between the first and second attachment locations 590, 592. Of course, it should be appreciated that adjustments in the positioning of the third divider web 538 may impact the variability of the height of the stack when the cellular shade 500 is moved to the retracted position.

As shown in the illustrated embodiment, the first cell structures 539 may generally be vertically aligned with one another along the heightwise direction of the cellular shade 500, with each first cell structure 539 being configured to form a closed-shape defining first and second sides. As particularly shown in FIG. 15, the first side of each first cell structure 539 may be formed by the second divider web 537 and the portion of an upper wall segment 548 extending between second divider web 537 and the first attachment location 590. Additionally, the second side of each first cell structure 539 may be formed by the third divider web 538 and the portion of a lower wall segment 554 extending between the second attachment location 592 and the second junction line 520.

Similarly, the second cell structures 540 may generally be vertically aligned with one another along the heightwise direction of the cellular shade 500, with each second cell structure 540 being configured to form a closed-shape defining first and second sides. As particularly shown in FIG. 15, the first side of each second cell structure 540 may be formed by the third divider web 538 and the portion of the upper wall segment 548 extending from the first attachment location 590 to the first junction line 518. Additionally, the second side of each second cell structure 540 may be formed by the first divider web 536 and the portion of the lower wall segment 554 extending between the first divider web 536 and the second attachment location 592.

Thus, due to the configuration of the cellular shade 500, each first and second cell structure 539, 540 may be configured to define portions of both the front face 502 and the rear face 504 of the cellular shade 500. For example, as shown in FIG. 15, the portions of the first and second cell structures 539, 540 formed by upper wall segment 548 may be configured to define portions of the rear face 504 of the cellular shade 500 while the portions of the first and second cell structures 539, 540 formed by the lower wall segment 554 may be configured to define portions of the front face 502 of the cellular shade 500.

Additionally, as shown in the illustrated embodiment, the third cell structures 541 may generally be vertically aligned with one another along the heightwise direction of the cellular shade 500, with each third cell structure 541 having a first side formed by the first divider web 536 and a second side extending outwardly from the adjacent second cell structure 540. Specifically, as shown in FIG. 15, the second side of each third cell structure 541 may be formed by a first wall segment 556 extending between the first junction line 518 and a fold or crease line 558 and a second wall segment 560 extending between the crease line 558 and the lower wall segment 554. Thus, the first and second wall segments 556, 560 of each third cell structure 541 in combination with the lower wall segment 554 may generally define the front face 502 of the cellular shade 500.

Moreover, as shown in the illustrated embodiment, the fourth cell structures 542 may generally be vertically aligned with one another along the heightwise direction of the cellular shade 500, with each fourth cell structure 542 having a first side and a second side. Specifically, as shown in FIG. 15, the second side of each fourth cell structure 542 may be formed by the second divider web 537. Additionally, the first side of each fourth cell structure 542 may be configured to extend outwardly from the adjacent first cell structure 539 and may be formed by a first wall segment 550 extending between the upper wall segment 548 and a fold or a crease line 551 and a second wall segment 552 extending between the crease line 551 and the second junction line 520. Thus, the first and second wall segments 550, 552 of each fourth cell structure 542 in combination with the upper wall segment 548 may generally define the rear face 504 of the cellular shade 500.

Similar to the embodiments described above, due to the configuration of the cellular shade 500, the third and fourth cell structures 541, 542 may be spaced apart vertically along the height of the cellular shade 500. Specifically, as shown in FIG. 14, the third cell structures 541 may be spaced apart from one another such that vertical gaps 561 are defined between the vertical ends of each adjacent pair of third cell structures 541. Similarly, the fourth cell structures 542 may be spaced apart from one another such that vertical gaps 562 are defined between the vertical ends of each adjacent pair of fourth cell structures 542.

As indicated above, the size and/or shape of the cell structures 539, 540, 541, 542 formed by the inclusion of the divider webs 536, 537, 538 may generally vary depending on the specific design parameters selected for the cellular shade 500. For example, given the configuration shown in the illustrated embodiment, each first and second cell structure 539, 540 includes sub-cell structures 539A, 539B, 540A, 540B generally defining substantially tear-drop shaped and substantially rectangular shaped cross-sections while each third and fourth cell structure 541, 542 generally defines a substantially "talon-shaped" cross-section. However, it should be appreciated that, in alternative embodiments, cell structures 539, 540, 541, 542 defining any other suitable sizes and/or shapes may be obtained by varying one or more of the design parameters of the cellular shade 500.

Additionally, as indicated above, the amount of light that is transmitted through the cellular shade 500 may also be impacted by the placement of the divider webs 536, 537, 538 within each shade cell 516, the overall length defined by each divider web 536, 537, 538 and/or the material(s) used to form each divider web 536, 537, 538. For instance, as shown in FIG. 15, due to the configuration of the illustrated cellular shade 500, all of the light hitting the cellular shade 500 may be required to pass through one of the divider webs 536, 537, 538. Thus, depending on the material(s) used to form such webs, all or a portion of the light hitting the cellular shade 500 may be prevented from being transmitted through the shade 500. For instance, by forming the divider webs 536, 537, 538 from a blackout material, the cellular shade 500 may be configured to function as a blackout shade when in the extended position. Of course, in other embodiments, any other suitable illumination or lighting effects may be provided by adjusting the configuration and/or relative positioning of the divider webs 536, 537, 538.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A cellular shade for an architectural opening, the cellular shade movable between an extended position and a retracted position, the cellular shade comprising:

a plurality of first cell structures aligned vertically with one another, each first cell structure extending between a first junction line and a second junction line, each first cell structure including a first side and a second side, the first side of each first cell structure defining at least a portion of a first face of the cellular shade, the second side of each first cell structure being defined at least partially by a first wall segment and a second wall segment, the first and second wall segments being formed from separate webs, the first and second wall segments extending to a common joint location positioned between the first and second junction lines; and a plurality of second cell structures aligned vertically with one another, each second cell structure being positioned adjacent to a corresponding first cell structure of the plurality of first cell structures, each second cell structure including a first side and a second side, the first side of each second cell structure being defined by the first wall segment of the corresponding first cell structure, wherein the second wall segment of each first cell structure and the second side of each second cell structure define at least a portion of a second face of the cellular shade, the second face being opposite the first face.

2. The cellular shade of claim 1, wherein the first wall segment is defined by a divider web forming a common wall between each second cell structure and its corresponding first cell structure.

3. The cellular shade of claim 2, wherein each second cell structure is defined by the divider web and at least one cell web, the at least one cell web defining the second side of the second cell structure, the at least one cell web further defining both the first side and the second wall segment of the first cell structure.

4. The cellular shade of claim 2, wherein the divider web is formed from a material that allows for at least 10% less light transmission than a material used to form the at least one cell web.

5. The cellular shade of claim 2, wherein the divider web is formed from a material that allows for at least 100% less light transmission than a material used to form the at least one cell web.

6. The cellular shade of claim 2, Wherein the divider web comprises a first divider web, further comprising a plurality of third cell structures vertically aligned with one another, each third cell structure being separated from a corresponding first cell structure of the plurality of first cell structures by a second divider web.

7. The cellular shade of claim 6, wherein an end of the first divider web is horizontally aligned with or horizontally overlaps an end of the second divider web.

8. The cellular shade of claim 6, further comprising a plurality of fourth cell structures vertically aligned within one another, each fourth cell structure being separated from a corresponding third cell structure of the plurality of third cell structures by a third divider web.

9. The cellular shade of claim 8, wherein the second divider web is configured to extend between the first and third divider webs so as to contact the first divider web at a first contact location and the third divider web at a second contact location.

10. The cellular shade of claim 1, wherein, when the cellular shade is at the extended position, adjacent second cell structures of the plurality of second cell structures are spaced apart vertically from one another such that a gap is defined between the adjacent second cell structures, the gap being horizontally aligned with at least a portion of the second side of one of the first cell structures.

11. The cellular shade of claim 1, wherein, when the cellular shade is at the extended position, each first cell structure defines a first height and each second cell structure defines a second height, the second height being equal to less than 75% of the first height.

12. A cellular shade for an architectural opening, the cellular shade movable between an extended position and a retracted position, the cellular shade comprising:

a plurality of first cell structures vertically aligned with one another, each first cell structure being formed by at least one cell web and including a first side and a second side extending between a first junction line and a second junction line, the first side of each first cell structure defining at least a portion of a first face of the cellular shade, the at least one cell web being coupled to at least one separate first adjacent cell web at the first junction line and to at least one separate second adjacent cell web at the second junction line; and a plurality of second cell structures aligned vertically with one another, each second cell structure being positioned adjacent to and extending outwardly from a corresponding first cell structure of the plurality of first cell structures;

wherein:

when the cellular shade is at the extended position, adjacent second cell structures of the plurality of second cell structures are spaced apart vertically from one another such that a gap is defined between the adjacent second cell structures;

the gap defines a vertical height across which a portion of the second side of each corresponding first cell structure is exposed along a second face of the cellular shade; and the second face is opposite the first face.

13. The cellular shade of claim 12, wherein the second side of each first cell structure includes a first wall segment and a second wall segment, and wherein each second cell structure includes a first side and a second side, the first side of each second cell structure being defined by the first wall segment of the corresponding first cell structure.

14. The cellular shade of claim 13, wherein the second wall segment of each first cell structure and the second side of each second cell structure define at least a portion of the second face of the cellular shade.

15. The cellular shade of claim 13, Wherein the gap extends along at least a portion of the second wall segment of one of the first cell structures.

16. The cellular shade of claim 13, wherein the first wall segment is defined by a divider web forming a common wall between each second cell structure and its corresponding first cell structure.

17. The cellular shade of claim 16, wherein the first side of each second cell structure is defined by the divider web and the second side of each second cell structure is defined by the at least one cell web, the at least one cell web further defining both the first side and the second wall segment of the first cell structure.

18. A cellular shade for an architectural opening, the cellular shade movable between an extended position and a retracted position, the cellular shade comprising:

a plurality of vertically aligned shade cells, each shade cell extending between a first junction line and a second junction line and being formed by at least one cell web defining a closed shape extending between the first and second junction lines along a first side and a second side of each shade cell, each shade cell including a first cell structure and a second cell structure defined within an interior of the closed shape, a first side of each first cell structure defining at least a portion of a first face of the cellular shade, adjacent second cell structures of the plurality of vertically aligned shade cells being spaced apart vertically from one another along a second when the cellular shade is at the extended position; and a divider web extending within each shade cell, the divider web being coupled to the at least one cell web at separate locations within the interior of the closed shape so as to form a common wall between the first cell structure and the second cell structure, the divider web being formed from a material that allows for less light transmission than a material used to form the at least one cell web, wherein:

the divider web is positioned within each shade cell such that a plurality of first light transmission bands and a plurality of second light transmission bands are formed along a heightwise direction of the cellular shade;

the plurality of first light transmission bands allowing less light to be transmitted through the cellular shade than the plurality of second light transmission bands; and the gap defines a vertical height across which a portion of a second side of each corresponding first cell structure is exposed along the second face of the cellular shade.

19. The cellular shade of claim 18, wherein the plurality of first and second light transmission bands are defined in an alternating configuration along the heightwise direction of the cellular shade.

20. The cellular shade of claim 18, wherein:

the second side of each first cell structure includes a first wall segment and a second wall segment;

each second cell structure includes a first side and a second side;

the first side of each second cell structure being defined by the first wall segment of the corresponding first cell structure; and the gap extends along at least a portion of the second wall segment of one of the first cell structures.

* * * * *